US007827791B2

(12) United States Patent
Pierson et al.

(10) Patent No.: US 7,827,791 B2
(45) Date of Patent: Nov. 9, 2010

(54) ADVANCED POWER RECOVERY AND ENERGY CONVERSION SYSTEMS AND METHODS OF USING SAME

(75) Inventors: Tom L. Pierson, Sugar Land, TX (US); John David Penton, Pasadena, TX (US)

(73) Assignee: TAS, Ltd., Houston, TX (US)

( * ) Notice: Subject to any disclaimer, the term of this patent is extended or adjusted under 35 U.S.C. 154(b) by 1049 days.

(21) Appl. No.: 11/243,544

(22) Filed: Oct. 5, 2005

(65) Prior Publication Data

US 2007/0245731 A1 Oct. 25, 2007

(51) Int. Cl.
*F01K 7/34* (2006.01)

(52) U.S. Cl. ..... 60/653; 60/677

(58) Field of Classification Search ..... 60/653, 60/670, 677

See application file for complete search history.

(56) References Cited

U.S. PATENT DOCUMENTS

| | | | | |
|---|---|---|---|---|
| 1,632,575 A | | 6/1927 | Abendroth | |
| 1,723,302 A | * | 8/1929 | Ruths | 60/655 |
| 3,194,219 A | * | 7/1965 | Hanzalek | 122/406.5 |
| 3,242,911 A | * | 3/1966 | Schroedter | 122/406.4 |
| 4,557,112 A | | 12/1985 | Smith | 60/651 |
| 4,586,340 A | | 5/1986 | Kalina | 60/673 |
| 4,604,867 A | | 8/1986 | Kalina | 60/653 |
| 4,732,005 A | | 3/1988 | Kalina | 60/673 |
| 4,899,545 A | | 2/1990 | Kalina | 60/673 |

(Continued)

FOREIGN PATENT DOCUMENTS

| | | |
|---|---|---|
| JP | 53-132638 | 11/1978 |

(Continued)

OTHER PUBLICATIONS

PCT Search Report and Written Opinion from PCT/US06/38721, dated May 10, 2007.

*Primary Examiner*—Hoang M Nguyen
(74) *Attorney, Agent, or Firm*—Williams, Morgan & Amerson, P.C.

(57) ABSTRACT

Disclosed herein are various systems and methods for producing mechanical power from a heat source. The system may include a heat recovery heat exchanger, a turbine, a condenser heat exchanger, and a liquid circulating pump, etc. In other embodiments, a desuperheater or an economizer, or both, may be employed. In one illustrative embodiment, the system comprises a first heat exchanger adapted to receive a fluid from a heat source and a working fluid, wherein, when the working fluid is passed through the first heat exchanger, the working fluid is converted to a vapor via heat transfer with the fluid from the heat source, at least one turbine adapted to receive the vapor, and an optional economizer heat exchanger adapted to receive exhaust vapor from the turbine and the working fluid, wherein a temperature of the working fluid is adapted to be increased via heat transfer with the exhaust vapor from the turbine prior to the introduction of the working fluid into the first heat exchanger. The system further comprises a condenser heat exchanger that is adapted to receive the exhaust vapor from the turbine after the exhaust vapor has passed through the optional economizer heat exchanger and a cooling fluid, wherein a temperature of the exhaust vapor is reduced via heat transfer with the cooling fluid, and a pump that is adapted to circulate the working fluid to the optional economizer heat exchanger.

32 Claims, 11 Drawing Sheets

U.S. PATENT DOCUMENTS

| | | | | |
|---|---|---|---|---|
| 5,029,444 | A | 7/1991 | Kalina | 60/673 |
| 5,095,708 | A | 3/1992 | Kalina | 60/673 |
| 5,440,882 | A | 8/1995 | Kalina | 60/641.2 |
| 5,557,936 | A | 9/1996 | Drnevich | 60/694 |
| 5,572,871 | A | 11/1996 | Kalina | 60/649 |
| 5,754,613 | A | 5/1998 | Hashiguchi et al. | 376/378 |
| 5,953,918 | A | 9/1999 | Kalina et al. | 60/653 |
| 6,058,695 | A | 5/2000 | Ranasinghe et al. | 60/39.182 |
| 6,195,997 | B1 | 3/2001 | Lewis et al. | 60/648 |
| 6,269,644 | B1 | 8/2001 | Erickson et al. | 60/649 |
| 6,318,065 | B1 | 11/2001 | Pierson | 60/39.02 |
| 6,321,552 | B1 | 11/2001 | Frederiksen | 62/238.3 |
| 6,347,520 | B1 | 2/2002 | Ranasinghe et al. | 60/649 |
| 6,470,686 | B2 | 10/2002 | Pierson | 60/772 |
| 6,571,548 | B1 | 6/2003 | Bronicki et al. | 60/39.02 |
| 6,581,384 | B1 | 6/2003 | Benson | 60/653 |
| 6,615,585 | B2 | 9/2003 | Tsuji | 60/728 |
| 6,698,214 | B2 * | 3/2004 | Chordia | 62/114 |
| 6,857,268 | B2 | 2/2005 | Stinger et al. | 60/651 |
| 7,010,920 | B2 * | 3/2006 | Saranchuk et al. | 60/670 |
| 2002/0017095 | A1 | 2/2002 | Pierson | 60/39.02 |
| 2002/0162330 | A1 | 11/2002 | Shimizu et al. | 60/651 |
| 2004/0011038 | A1 | 1/2004 | Stinger et al. | 60/651 |
| 2004/0182082 | A1 | 9/2004 | Saranchuk et al. | 60/698 |

FOREIGN PATENT DOCUMENTS

| | | |
|---|---|---|
| JP | 59-068505 | 4/1984 |

* cited by examiner

ADVANCED POWER RECOVERY AND ENERGY CONVERSION SYSTEMS AND METHODS OF USING SAME

BACKGROUND OF THE INVENTION

1. Field of the Invention

The present invention generally relates to heat recovery for the purpose of electrical or mechanical power generation. Specifically, the present invention is directed to various systems and methods for the conversion of heat of any quality into mechanical or electrical power.

2. Description of the Related Art

In general, there is a constant drive to increase the operating efficiency of heat and power recovery systems. By increasing the efficiency of such systems, capital costs may be reduced, more power may be generated and there may be a reduction of possible adverse impacts on the environment, e.g., a reduction in the amount of waste heat that must ultimately be absorbed by the environment. In other industrial processes, an excess amount of heat may be generated as a byproduct of the process. In many cases, such waste heat is normally absorbed by the environment through the use of waste heat rejection devices such as cooling towers.

There are several systems employed in various industries to produce useful work from a heat source. Such systems may including the following:

Heat Recovery Steam Generators (HRSG)—Typically, waste heat from gas turbines or other, similar, high quality heat sources is recovered using steam at multiple temperatures and pressures. Multiple operating levels are required because the temperature-enthalpy profile is not linear. That is, such prior art systems involve isothermal (constant temperature) boiling as the working fluid, i.e. water, is converted from a liquid to a vapor state. Various embodiments of the present invention eliminate the need for multiple levels and simplify the process while having the capability to recover more heat and to economically recover heat from a much lower quality heat source.

Rankine Cycle—The classic Rankine cycle is utilized in conjunction with HRSGs to produce power. This process is complex and requires either multiple steam turbines or a multi-stage steam turbine, feed water heaters, steam drums, pumps, etc. The methods and systems of the present invention are significantly less complex while being more effective than systems employing the Rankine cycle.

Organic Rankine Cycle—Similar to the classic Rankine cycle, an Organic Rankine cycle utilizes a low temperature working fluid such as isoButane or isoPentane in place of steam in the classic cycle. The system remains complex and is highly inefficient at low operating temperature differences.

Kalina Cycle—Dr. Kalina's cycle is a next generation enhancement to the Rankine cycle utilizing a binary fluid mixture, typically water and ammonia. Water and ammonia are utilized at different concentrations in various portions of the process to extend the temperature range potential of the cycle and to allow higher efficiencies than are possible in the Rankine cycle. The methods and systems of the present invention simplifies the process while having the capability to recover more heat and to recover heat from a low quality heat source.

The system depicted in FIG. 10 is an example of a prior art system for heat recovery. The system comprises two heat recovery heat exchangers 120 and 121, two turbines (expanders) 122 and 124, and a reheater heat exchanger 123. The prior art system may or may not have a separate gas cooler 125 and condenser 126. The subcritical working fluid 102 enter the first heat recovery heat exchanger 120 at approximately the condensing temperature from a condenser 126. The liquid 102 is heated via heat transfer with the discharged hot fluid 114 from the reheater heat exchanger 123 and is discharged as either a wet or dry vapor 103 after boiling either partially or completely in heat recovery heat exchanger 120. The working fluid 103 is further heated in the second heat recovery heat exchanger 121 to a dry vapor 104 via heat transfer with the hot heat source 112 and is supplied to the inlet of the first turbine 122. In at least some cases, the vapor 104 is at a temperature near or slightly above its critical temperature but well below its critical pressure. The hot vapor 104 is expanded in turbine 122 and exits as a hot vapor 105. The hot vapor 105 is introduced into a reheater heat exchanger 123 where is heated (reheated) by the hot heating fluid 113 discharged from the second heat recovery heat exchanger 121 via heat transfer. The reheated working fluid 106 is then supplied to the inlet of the second turbine 124 wherein it is expanded and discharged as a hot, typically dry and highly superheated, vapor 107. The discharged vapor 107 from the second turbine 124 may or may not be cooled in a gas cooler 125 before being condensed in a condenser heat exchanger 126.

In the prior art system of FIG. 10, the subcritical working fluid 102 enter the first heat recovery heat exchanger 120 at approximately the condensing temperature from a condenser 126. Said liquid 102 is heated via heat transfer with the discharged hot fluid 114 from the reheater heat exchanger 123 and is discharged as either a wet or dry vapor 103 after boiling either partially or completely in heat recovery heat exchanger 120. Said working fluid 103 is further heated in the second heat recovery heat exchanger 121 to a dry vapor 104 via heat transfer with the hot heat source 112 and is supplied to the inlet of the first turbine 122. In the most preferred embodiment the vapor 104 is at a temperature near or slightly above its critical temperature but well below its critical pressure. The hot vapor 104 is expanded in turbine 122 and exits as a hot vapor 105. Such hot vapor 105 is introduced into a reheater heat exchanger 123 where is heated (reheated) by the hot heating fluid 113 discharged from the second heat recovery heat exchanger 121 via heat transfer. The reheated working fluid 106 is then supplied to the inlet of the second turbine 124 wherein it is expanded and discharged as a hot, typically dry and highly superheated, vapor 107. The discharged vapor 107 from the second turbine 124 may or may not be cooled in a gas cooler 125 before being condensed in a condenser heat exchanger 126.

The four largest weaknesses of the prior art system are a) the vapor 107 discharged from the second turbine 124 is significantly superheated and thereby the system of FIG. 10 fails to recover a portion of the valuable heat, b) the system utilizes a subcritical working fluid which limits the efficiency of the heat recovery in the heat recovery heat exchangers 120 and 121 due to the non-linearity of the temperature-enthalpy profile in said exchangers, c) the system generates unnecessary entropy further reducing its output in accordance with the Second Law of Thermodynamics, and d) the complexity of the system having multiple turbines and multiple heat recovery heat exchangers is reflected in an increased cost of the system for a given capacity. recovery heat exchanger(s) are usually the largest costs in a system of the type.

The following patents may be descriptive of various aspects of the prior art: U.S. Pat. No. 5,557,936 to Drnevich; U.S. Pat. No. 5,029,444 to Kalina; U.S. Pat. No. 5,440,882 to Kalina; U.S. Pat. No. 5,095,708 to Kalina; U.S. Pat. No. 5,572,871 to Kalina; Japanese Patent S53-132638A to Nakahara and Fujiwara; U.S. Pat. No. 6,195,997 to Lewis; U.S. Pat. No. 4,577,112 to Smith; each of which are hereby incorporated by reference.

In general, what is desired are systems and methods for improving the efficiencies of various heat conversion and power generation systems and systems and methods for utilizing waste heat sources to improve operating efficiencies of various power and industrial systems. The present invention is directed to various systems and methods that may solve, or at least reduce, some or all of the aforementioned problems.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present invention is generally directed to various systems and methods for producing mechanical power from a heat source. In various illustrative examples, the devices employed in practicing the present invention may include a heat recovery heat exchanger, a turbine or an expander, a desuperheater heat exchanger, an economizer heat exchanger, a condenser heat exchanger, an accumulator, and a liquid circulating pump, etc. In one illustrative embodiment, the system comprises a first heat exchanger adapted to receive a fluid from a heat source and a working fluid, wherein, when the working fluid is passed through the first heat exchanger, the working fluid is converted to a vapor via heat transfer from the heat contained in the fluid from the heat source, and at least one turbine is adapted to receive the vapor. The system further comprises a condenser heat exchanger that is adapted to receive the exhaust vapor from the turbine or expander and a pump that is adapted to circulate the working fluid to the first heat exchanger.

In another illustrative embodiment, the system comprises a first heat exchanger adapted to receive a fluid from a heat source and a working fluid, wherein, when the working fluid is passed through the first heat exchanger, the working fluid is converted to a vapor via heat transfer from the heat contained in the fluid from the heat source, at least one turbine is adapted to receive the vapor, and an economizer heat exchanger adapted to receive exhaust vapor from the turbine and the working fluid, wherein a temperature of the working fluid is adapted to be increased via heat transfer with the exhaust vapor from the turbine prior to the introduction of the working fluid into the first heat exchanger. The system further comprises a condenser heat exchanger that is adapted to receive the exhaust vapor from the turbine after the exhaust vapor has passed through the economizer heat exchanger and a cooling fluid, wherein a temperature of the exhaust vapor is reduced via heat transfer with the cooling fluid, and a pump that is adapted to circulate the working fluid to the economizer heat exchanger.

In another illustrative embodiment, the system comprises a first heat exchanger adapted to receive a fluid from a heat source and a working fluid, wherein, when the working fluid is passed through the first heat exchanger, the working fluid is converted to a vapor via heat transfer from the heat contained in the fluid from the heat source, and at least one turbine adapted to receive the vapor. The system further comprises a desuperheater heat exchanger adapted to receive exhaust vapor from the turbine and a portion of the working fluid extracted upstream of the first heat exchanger, wherein the temperature of the exhaust vapor from the turbine is adapted to be reduced via heat transfer with the working fluid in the desuperheater heat exchanger, a condenser heat exchanger that is adapted to receive working fluid exiting the desuperheater heat exchanger and a cooling fluid, wherein a temperature of the working fluid is adapted to be reduced via heat transfer with the cooling fluid in the condenser heat exchanger, and a pump adapted to circulate the working fluid to the first heat exchanger.

In another illustrative embodiment, the system comprises a first heat exchanger adapted to receive a fluid from a heat source and a working fluid, wherein, when the working fluid is passed through the first heat exchanger, the working fluid is converted to a vapor via heat transfer from the heat contained in the fluid from the heat source, at least one turbine is adapted to receive the vapor, and an economizer heat exchanger adapted to receive exhaust vapor from the turbine and the working fluid, wherein a temperature of the working fluid is adapted to be increased via heat transfer with the exhaust vapor from the turbine prior to the introduction of the working fluid into the first heat exchanger. The system further comprises a desuperheater heat exchanger that is adapted to receive the exhaust vapor after the exhaust vapor has passed through the economizer heat exchanger and the turbine, and a cooling fluid, wherein a temperature of the exhaust vapor is reduced via heat transfer with the cooling fluid, and a pump that is adapted to circulate the working fluid to the economizer heat exchanger directly and the desuperheater heat exchanger via a pressure reducing valve. The system further comprises a condenser heat exchanger that is adapted to receive the exhaust vapor from the turbine after the exhaust vapor has passed through the economizer heat exchanger and the desuperheater heat exchanger and a cooling fluid, wherein a temperature of the exhaust vapor is reduced via heat transfer with the cooling fluid, and a pump that is adapted to circulate the working fluid to the economizer heat exchanger directly and the desuperheater heat exchanger via a pressure reducing valve.

In all of the illustrative examples, the condenser heat exchanger might be adapted to receive any one or a plurality of cooling fluids such as water from a cooling tower; water from a river or stream; water from a pond, lake, bay, or other freshwater source; seawater from a bay, canal, channel, sea, ocean, or other source; chilled water; fresh air; chilled air; a liquid process stream, e.g. propane; a gaseous process stream, e.g. nitrogen; or other heat sink such as a ground source cooling loop comprised of a plurality of buried pipes.

BRIEF DESCRIPTION OF THE DRAWINGS

The invention may be understood by reference to the following description taken in conjunction with the accompanying drawings, in which like reference numerals identify like elements, and in which.

Figure 1:
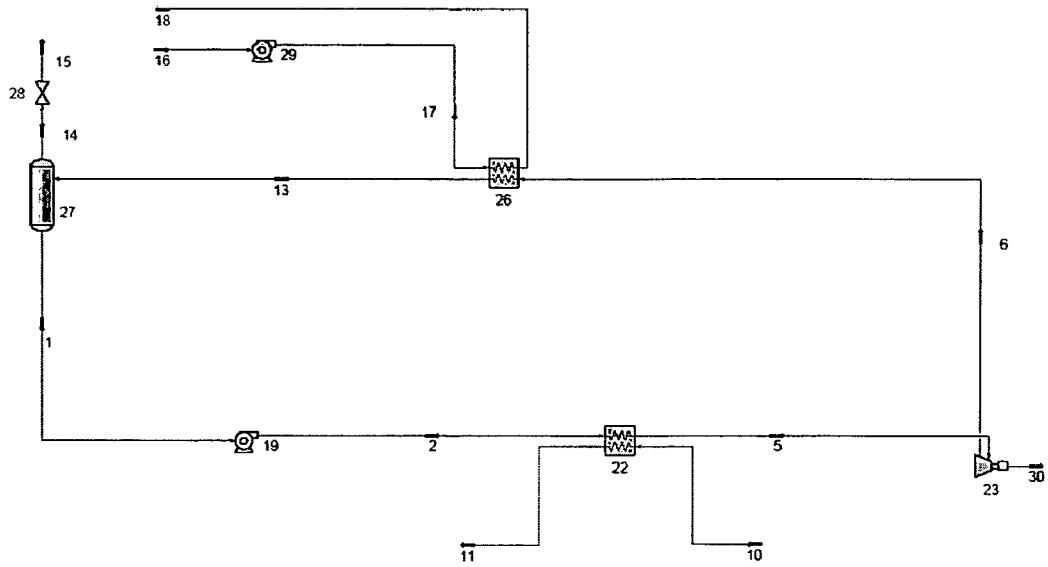
FIG. 1 is a schematic diagram of one illustrative embodiment of the present invention employing the simplest cycle utilizing a working fluid circulating pump, a heat recovery heat exchanger, a turbine or expander, a liquid cooled condenser heat exchanger, a cooling liquid circulating pump, and an accumulator.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached drawings which are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e. a meaning other than that understood by skilled artisans, such a special definition will be expressly set forth in the specification in a definitional manner that directly and unequivocally provides the special definition for the term or phrase. Moreover, various streams or conditions may be referred to with terms such as "hot," "cold," "cooled, "warm," etc., or other like terminology. Those skilled in the art will recognize that such terms reflect conditions relative to another process stream, not an absolute measurement of any particular temperature.

The present invention is generally related to pending allowed U.S. patent application Ser. No. 10/616,074, now U.S. Pat. No. 6,964,168. That pending application is hereby incorporated by reference in its entirety.

One illustrative embodiment of the present invention will now be described with reference to FIG. 1. As shown therein, a high pressure liquid 2 enters a first heat exchanger 22 and exits as a superheated vapor 5 due to heat transfer with a hot fluid, either a gas, a liquid, or a two-phase mixture of gas and liquid entering at 10 and exiting at 11. The vapor 5 may be a subcritical or supercritical vapor. The heat exchanger 22 may be any type of heat exchanger capable of transferring heat from one fluid stream to another fluid stream. For example, the heat exchanger 22 may be a shell-and-tube heat exchanger, a plate-fin-tube coil type of exchanger, a bare tube or finned tube bundle, a welded plate heat exchanger, etc. Thus, the present invention should not be considered as limited to any particular type of heat exchanger unless such limitations are expressly set forth in the appended claims.

The source of the hot fluid 10 for the heat exchanger 22 may either be a waste heat source (from any of a variety of sources) or heat may intentionally be supplied to the system, e.g. by a gas burner, a fuel oil burner, or the like. In one illustrative embodiment, the source of the hot fluid 10 for the heat exchanger 22 is a waste heat source such as the exhaust from an internal combustion engine (e.g. a reciprocating diesel engine), a combustion gas turbine, a compressor, or an industrial or manufacturing process. However, any heat source of sufficient quantity and temperature may be utilized if it can be obtained economically. In some cases, the heat exchanger 22 may be referred to either as a "waste heat recovery heat exchanger," indicating that the source of the fluid 6 is from what would otherwise be a waste heat source, although the present invention is not limited to such situations, or a "heat recovery heat exchanger" indicating that the source of the fluid 10 is from what would be any heat source.

In one embodiment, the vapor 5 then enters the turbine (expander) 23. For purposes of the present application, the term "turbine" will be understood to include both turbines and expanders or any device wherein useful work is generated by expanding a high pressure gas within the device. The vapor 5 is expanded in the turbine (expander) 23 and the design of the turbine converts kinetic and potential energy of the dry vapor 5 into mechanical energy in the form of torque on an output shaft 30. Any type of commercially available turbine suited for use in the systems described herein may be employed, e.g. an expander, a turbo-expander, a power turbine, etc. The shaft horsepower available on the shaft 30 of the turbine 23 can be used to produce power by driving one or more generators, compressors, pumps, or other mechanical devices, either directly or indirectly. Several illustrative embodiments of how such useful power may be used are described further in the application. Additionally, as will be recognized by those skilled in the art after a complete reading of the present application, a plurality of turbines 23 or heat recovery heat exchangers 22 may be employed with the system depicted in FIG. 1.

The low pressure, high temperature discharge 6 from the turbine 23 is routed to a condenser heat exchanger 26. The condenser 26 condenses the slightly superheated, low pressure gas 6 and condenses it to the liquid state using water, seawater, or other liquid or boiling fluid 17 which might be circulated by a low pressure liquid circulating pump 29 which provides the necessary motive force to circulate the cooling fluid from point 16 to point 18. The condenser 26 may be utilized to condense the hot working fluid from a vapor to a liquid at a temperature ranging from approximately 50-250° F.

The condensed liquid 13 is introduced into an accumulator drum 27. The drum 27 may serve several purposes, such as, for example: (a) the design of the drum 27 ensures that the pump 19 has sufficient head to avoid cavitation; (b) the design of the drum 27 ensures that the supply of liquid 1 to the pump 19 is steady; (c) the design of the drum 27 ensures that the pump 19 will not be run dry; (d) the design of the drum 27 provides an opportunity to evacuate any non-condensable vapors from the system through a vent valve 28 via lines 14, 15; (e) the design of the drum 27 allows for the introduction of process liquid into the system; and (f) the design of the drum 27 allows for the introduction of makeup quantities of process liquid in the event that a small amount of operating fluid is lost.

The high pressure discharge 2 of the pump 19 is fed to the heat recovery heat exchanger 22. The pump 19 may be any type of commercially available pump sufficient to meet the pumping requirements of the systems disclosed herein. In various embodiments, the pump 19 may be sized such that the discharge pressure of the working fluid ranges from approximately 300 psia to 1500 psia. In one particularly illustrative embodiment, the selection of the discharge pressure of the pump 19 is dependent on the critical pressure of the working fluid 2 and should be approximately 5 psia to 500 psia greater than the critical pressure of the working fluid 2 although pressures lower than the critical pressure may be utilized with a reduction in the efficiency of the system.

In one illustrative embodiment, the working fluid enters the heat recovery heat exchanger 22 as a high pressure liquid and leaves as a superheated vapor 5. The high pressure, superheated vapor is then expanded through a turbine 23 to produce mechanical power. The vapor 6 exiting the turbine 23 is at low pressure and in the superheated state. This superheated vapor is then introduced into the condenser heat exchanger 26 which may be water cooled, air cooled, evaporatively cooled, or used as a heat source for district heating, domestic hot water, or similar heating load. The condensed low pressure liquid 13 is fed to the suction of a pump 19 via a drum 27 and is pumped to the high pressure required for the heat recovery heat exchanger 22.

The present invention may employ a single component working fluid that may be comprised of, for example, ammonia (NH3), bromine (Br2), carbon tetrachloride (CC14), ethyl alcohol or ethanol (CH3CH2OH, C2H6O), furan (C4H4O), hexafluorobenzene or perfluoro-benzene (C6F6), hydrazine (N2H4), methyl alcohol or methanol (CH3OH), monochlorobenzene or chlorobenzene or chlorobenzol or benzine chloride (C6H5C1), n-pentane or normal pentane (nC5), i-hexane or isohexane (iC5), pyridene or azabenzene (C5H5N), refrigerant 11 or freon 11 or CFC-11 or R-11 or trichlorofluoromethane (CC13F), refrigerant 12 or freon 12 or R-12 or dichlorodifluoromethane (CC12F2), refrigerant 21 or freon 21 or CFC-21 or R-21 (CHC12F), refrigerant 30 or freon 30 or CFC-30 or R-30 or dichloromethane or methylene chloride or methylene dichloride (CH2C12), refrigerant 115 or freon 115 or CFC-115 or R-115 or chloro-pentafluoroethane or monochloropentafluoroethane, refrigerant 123 or freon 123 or HCFC-123 or R-123 or 2,2 dichloro-1,1,1-trifluoroethane, refrigerant 123a or freon 123a or HCFC-123a or R-123a or 1,2-dichloro-1,1,2-trifluoroethane, refrigerant 123b1 or freon 123b1 or HCFC-123b1 or R-123b1 or halothane or 2-bromo-2-chloro-1,1,1-trifluoroethane, refrigerant 134A or freon 134A or HFC-134A or R-134A or 1,1,1,2-tetrafluoroethane, refrigerant 150A or freon 150A or CFC-150A or R-150A or dichloroethane or ethylene dichloride (CH3CHC12), thiophene (C4H4S), toluene or methylbenzene or phenylmethane or toluol (C7H8), water (H2O), etc. In some applications, the working fluid may be comprised of multiple components. For example, one or more of the compounds identified above may be combined or with a hydrocarbon fluid, e.g. isobutene, etc. Further, several simple hydrocarbons compounds may be combined such as isopentane, toluene, and hexane to create a working fluid. In the context of the present application, reference may be made to the use of methyl alcohol or methanol as the working fluid and to provide certain illustrative examples. However, after a complete reading of the present application, those skilled in the art will recognize that the present invention is not limited to any particular type of working fluid or refrigerant. Thus, the present invention should not be considered as limited to any particular working fluid unless such limitations are clearly set forth in the appended claims.

In the present invention, as the working fluid passes through the heat exchanger 22, it changes from a liquid state to a vapor state in a non-isothermal process using an approximately linear temperature-enthalpy profile, i.e., the slope of the temperature-enthalpy curve does not change significantly even though the working fluid changes state from a subcooled liquid to a superheated vapor. The slope of the temperature-enthalpy graph may vary depending upon the application. Moreover, the temperature-enthalpy profile may not be linear over the entire range of the curve.

The temperature-enthalpy profile of the working fluid of the present invention is fundamentally different from other systems. For example, a temperature-enthalpy profile for a typical Rankine cycle undergoes one or more essentially isothermal (constant temperature) boiling processes as the working fluid changes from a liquid state to a vapor state. Other systems, such as a Kalina cycle, may exhibit a more non-isothermal conversion of the working fluid from a liquid state to a vapor state, but such systems employ binary component working fluids, such as ammonia and water.

The non-isothermal process used in practicing aspects of the present invention is very beneficial in that it provides a greater heat capacity that may be recaptured when the vapor is cooled back to a liquid. That is, due to the higher temperatures involved in such a non-isothermal process, the working fluid, in the superheated vapor state, contains much more useable heat energy that may be recaptured and used for a variety of purposes. Further, the nearly linear temperature-enthalpy profile allows the exiting temperature 11 of the (waste) heat source to approach more closely to the working fluid temperature 2 entering the heat exchanger 22.

By way of example, with reference to FIG. 1, in one illustrative embodiment where the working fluid is methyl alcohol or methanol, the temperature of the working fluid at point 2 may be between approximately 50-250° F. at approximately 1120 psia to 1220 psia at the discharge of the pump 19. The working fluid at point 13 may be at a pressure of approximately 1 psia to 92 psia at the discharge of the condenser 26 (see FIG. 1) for a system pressure ratio of between approximately between twelve to one (12:1) and one thousand two hundred and twenty to one (1220:1). In one particularly illustrative embodiment, the pressure ratio may be as large as practical. The temperature of the methanol working fluid 5 at the exit of the heat exchanger 22 may be approximately 500-1000° F. The temperature of the methanol working fluid 6 at the exit of the turbine 23 may be between approximately 90° F. at a pressure of approximately 3 psia and 670° F. at a pressure of approximately 92 psia. The temperature of the methanol working fluid 6 at the exit of the turbine 23 may be superheated by between approximately 10° F. (at a pressure of approximately 8 psia at 6 entering the turbine 23 at 650° F. at 5) and approximately 415° F. (at a pressure of 92 psia at 6 entering the turbine 23 at 1000° F. at 5). The amount of superheat in the working fluid at 6 is functionally related to the pressure ratio of the system, the efficiency of the turbine 23, the thermodynamic properties of the working fluid, and the degree of superheat at 5 entering the turbine. In one particularly illustrative embodiment, the superheat in the working fluid at 6 would be as close as possible to zero although the additional embodiments of the present invention will describe related systems that will allow large amounts of superheat at 5 and at 6 and still remain efficient.

In another illustrative embodiment where the working fluid is bromine, the temperature of the working fluid at point 2 may be between approximately 50-250° F. at approximately 1540 psia at the discharge of the pump 19. The working fluid at point 13 may be at a pressure of approximately 11 psia at the discharge of the condenser 26 for a system pressure ratio of approximately one hundred and forty to one (140:1). The temperature of the bromine working fluid 5 at the exit of the heat exchanger 22 may be approximately 650-1000° F. The temperature of the bromine working fluid 6 at the exit of the turbine 23 may be approximately 130° F. at a pressure of approximately 13 psia.

In another illustrative embodiment where the working fluid is carbon tetrachloride, the temperature of the working fluid at point 2 may be between approximately 50-250° F. at approximately 690 psia at the discharge of the pump 19. The working fluid at point 13 may be at a pressure of approximately 6 psia at the discharge of the condenser 26 for a system pressure ratio of approximately one hundred thirty to one (130:1). The temperature of the carbon tetrachloride working fluid 5 at the exit of the heat exchanger 22 may be approximately 550-770° F. The temperature of the carbon tetrachloride working fluid 6 at the exit of the turbine 23 may be approximately 155-400° F. at a pressure of approximately 8 psia.

In another illustrative embodiment where the working fluid is ethyl alcohol or ethanol, the temperature of the working fluid at point 2 may be between approximately 50-250° F. at approximately 1000 psia at the discharge of the pump 19. The working fluid at point 13 may be at a pressure of approximately 4 psia at the discharge of the condenser 26 for a system pressure ratio of approximately two hundred and fifty to one (250:1). The temperature of the ethyl alcohol or ethanol working fluid 5 at the exit of the heat exchanger 22 may be approximately 500-800° F. The temperature of the ethyl alcohol or ethanol working fluid 6 at the exit of the turbine 23 may be approximately 135-400° F. at a pressure of approximately 6 psia.

In another illustrative embodiment where the working fluid is R-150A, the temperature of the working fluid at point 2 may be between approximately 50-250° F. at approximately 770 psia at the discharge of the pump 19. The working fluid at point 13 may be at a pressure of approximately 11 psia at the discharge of the condenser 26 for a system pressure ratio of approximately seventy to one (70:1). The temperature of the R-150A working fluid 5 at the exit of the heat exchanger 22 may be approximately 500-705° F. The temperature of the R-150A working fluid 6 at the exit of the turbine 23 may be approximately 155-400° F. at a pressure of approximately 13 psia.

In another illustrative embodiment where the working fluid is thiophene, the temperature of the working fluid at point 2 may be between approximately 50-250° F. at approximately 900 psia at the discharge of the pump 19. The working fluid at point 13 may be at a pressure of approximately 4.5 psia at the discharge of the condenser 26 for a system pressure ratio of approximately two hundred to one (200:1). The temperature of the thiophene working fluid 5 at the exit of the heat exchanger 22 may be approximately 600-730° F. The temperature of the thiophene working fluid 6 at the exit of the turbine 23 may be approximately 220-400° F. at a pressure of approximately 6.5 psia.

In another illustrative embodiment where the working fluid is a mixture of hydrocarbon compounds, the temperature of the working fluid at point 2 may be between approximately 50-250° F. at approximately 576 psia at the discharge of the pump 19. The working fluid at point 13 may be at a pressure of approximately 36 psia at the discharge of the condenser 26 for a system pressure ratio of approximately sixteen to one (16:1). The temperature of the mixture of hydrocarbon compounds working fluid 5 at the exit of the heat exchanger 22 may be approximately 520-655° F. The temperature of the mixture of hydrocarbon compounds working fluid 6 at the exit of the turbine 23 may be approximately 375-550° F. at a pressure of approximately 38 psia. For this illustrative example, the mixture of hydrocarbons on a molar basis may be approximately 10% propane, 10% isobutane, 10% isopentane, 20% hexane, 20% heptane, 10% octane, 10% nonane, and 10% decane. This mixture is one of an infinite number of possible mixtures that might be selected to suit specific needs of a particular embodiment and is in no way representative of the only or best solution.

The methods and systems described herein are effective for pressure ratios greater than three to one (3:1) and the pressure ratio is determined by the physical characteristics of the working fluid being utilized. The specific selection of the low cycle pressure is determined by the condensing pressure of the working fluid and will be, typically, the saturation pressure of the working fluid at between approximately 50-250° F., depending on the cooling medium or condenser heat exchanger type and the ambient temperature or ultimate heat sink temperature. The specific selection of the high cycle pressure is determined by the thermodynamic properties of the working fluid plus a margin, as a minimum, and by cycle efficiency, pump power consumption, and maximum component design pressures as a maximum.

Figure 2:
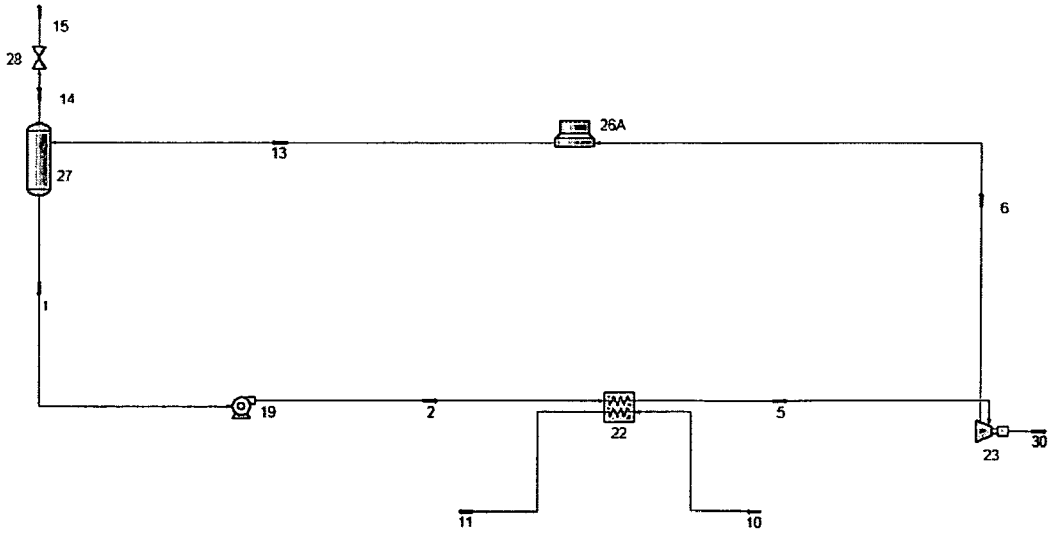
FIG. 2 is a schematic diagram of one illustrative embodiment of the present invention employing the simplest cycle utilizing a working fluid circulating pump, a heat recovery heat exchanger, a turbine or expander, a gas or air cooled condenser heat exchanger, and an accumulator.

In another illustrative embodiment of the present invention a system substantially similar to FIG. 1 will now be described with reference to FIG. 2. The low pressure, high temperature discharge 6 from the turbine 23 is routed to a condenser heat exchanger 26A. The condenser 26A condenses the slightly superheated, low pressure gas 6 and condenses it to the liquid state using air or other gas most preferably with a fan used to draw or force the gas over a heat exchanger for the purpose of enhancing heat transfer. The condenser 26A may be utilized to condense the hot working fluid from a vapor to a liquid at a temperature ranging from approximately 0-250° F. The most notable difference between the embodiment of FIG. 1 and the embodiment of FIG. 2 is that the condenser heat exchanger 26A is gas cooled for the later and liquid cooled for the former (FIGS. 1, 26).

Figure 3:
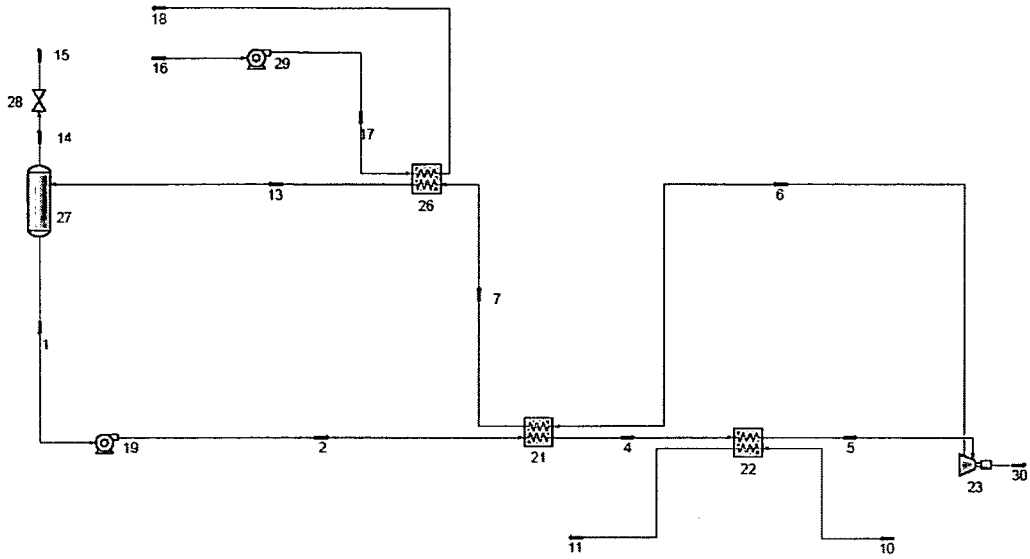
FIG. 3 is a schematic diagram of one illustrative embodiment of the present invention employing a working fluid circulating pump, an economizer heat exchanger, a heat recovery heat exchanger, a turbine or expander, a liquid cooled condenser heat exchanger, a cooling liquid circulating pump, and an accumulator.

In another illustrative embodiment of the present invention, as shown in FIG. 3, a system similar to FIG. 1 is utilized with the addition of an economizer heat exchanger 21 to enhance the efficiency of the process and reduce the temperature of the exhaust vapor 6 exiting the turbine 23 while preheating the working fluid from state 2 to state 4 before supplying the working fluid 4 to the heat recovery heat exchanger 22. The economizer heat exchanger 21 not only enhances the efficiency of the cycle by recovering wasted heat internal to the cycle, it also has the added benefit of reducing the size and cost of the condenser heat exchanger 26.

As shown in FIG. 3, a high pressure liquid 2 enters the economizer heat exchanger 21 and exits as a heated liquid 4 due to heat transfer with the hot vapor 6 exiting the turbine 23. The heated high pressure liquid 4 then enters a heat recovery heat exchanger 22 and exits as a vapor 5 due to heat transfer with a hot fluid, either a gas, a liquid, or a two-phase mixture of gas and liquid entering at 10 and exiting at 11. The vapor 5 may be a subcritical or supercritical vapor. The heat exchangers 21 and 22 may be any type of heat exchanger capable of transferring heat from one fluid stream to another fluid stream. The source of the hot fluid 10 for the heat exchanger 22 may either be a waste heat source (from any of a variety of sources) or heat may intentionally be supplied to the system, or the like. In one illustrative embodiment, the source of the hot fluid 10 for the heat exchanger 22 is a waste heat source such as the exhaust from an internal combustion engine, a combustion gas turbine, a compressor, or an industrial or manufacturing process.

In one embodiment, the vapor 5 then enters the turbine (expander) 23 and the vapor 5 is expanded in the turbine 23. The design of the turbine 23 converts kinetic and potential energy of the dry vapor 5 into mechanical energy in the form of torque on an output shaft 30. Any type of commercially available turbine suited for use in the systems described herein may be employed, e.g. an expander, a turbo-expander, a power turbine, etc. The shaft horsepower available on the shaft 30 of the turbine 23 can be used to produce power by driving one or more generators, compressors, pumps, or other mechanical devices, either directly or indirectly. Additionally, as will be recognized by those skilled in the art after a complete reading of the present application, a plurality of turbines 23 or heat recovery heat exchangers 22 may be employed with the system depicted in FIG. 3.

The low pressure, high temperature discharge 6 from the turbine 23 is routed to the economizer heat exchanger 21. The economizer heat exchanger 21 cools the superheated, low pressure gas 6 via heat transfer with the high pressure liquid 2. The economizer heat exchanger 21 normally has an minimum approach temperature ranging from approximately 20-100° F.

The slightly superheated, low pressure, low temperature discharge 7 from the economizer heat exchanger 21 is routed to a condenser heat exchanger 26. The condenser 26 condenses the slightly superheated, low pressure gas 7 to the liquid state using water, seawater, or other liquid or boiling fluid 17 which might be circulated by a low pressure liquid circulating pump 29 which provides the necessary motive force to circulate the cooling fluid from point 16 to point 18. The condenser 26 may be utilized to condense the hot working fluid from a vapor to a liquid at a temperature ranging from approximately 50-250° F.

The condensed liquid 13 is introduced into an accumulator drum 27. As described previously, the drum 27 may serve several purposes, such as, for example: (a) the design of the drum 27 ensures that the pump 19 has sufficient head to avoid cavitation; (b) the design of the drum 27 ensures that the supply of liquid 1 to the pump 19 is steady; (c) the design of the drum 27 ensures that the pump 19 will not be run dry; (d) the design of the drum 27 provides an opportunity to evacuate any non-condensable vapors from the system through a vent valve 28 via lines 14, 15; (e) the design of the drum 27 allows for the introduction of process liquid into the system; and (f) the design of the drum 27 allows for the introduction of makeup quantities of process liquid in the event that a small amount of operating fluid is lost.

The high pressure discharge 2 of the pump 19 is fed to the economizer heat exchanger 21. The pump 19 may be any type of commercially available pump sufficient to meet the pumping requirements of the systems disclosed herein. In various embodiments, the pump 19 may be sized such that the discharge pressure of the working fluid ranges from approximately 300 psia to 1500 psia. In one particularly illustrative embodiment, the selection of the discharge pressure of the pump 19 is dependent on the critical pressure of the working fluid 2 and should be approximately 5 psia to 500 psia greater than the critical pressure of the working fluid 2 although pressures lower than the critical pressure may be utilized with a reduction in the efficiency of the system.

By way of example, with reference to FIG. 3, in one illustrative embodiment where the working fluid is methyl alcohol or methanol, the temperature of the working fluid at point 2 may be between approximately 50-250° F. at approximately 1120 psia to 1220 psia at the discharge of the pump 19. The working fluid at point 13 may be at a pressure of approximately 1 psia to 92 psia at the discharge of the condenser 26 (see FIG. 3) for a system pressure ratio of between approximately between twelve to one (12:1) and one thousand two hundred and twenty to one (1220:1). In one particularly illustrative embodiment, the pressure ratio would be as large as practical. The temperature of the methanol working fluid 5 at the exit of the heat exchanger 22 may be approximately 500-1000° F. The temperature of the methanol working fluid 6 at the exit of the turbine 23 may be between approximately 90° F. at a pressure of approximately 3 psia and 670° F. at a pressure of approximately 92 psia. The temperature of the methanol working fluid 6 at the exit of the turbine 23 may be superheated by between approximately 110° F. (at a pressure of approximately 8 psia at 6 entering the turbine 23 at 650° F. at 5) and approximately 415° F. (at a pressure of 92 psia at 6 entering the turbine 23 at 1000° F. at 5). The amount of superheat in the working fluid at 6 is functionally related to the pressure ratio of the system, the efficiency of the turbine 23, the thermodynamic properties of the working fluid, and the degree of superheat at 5 entering the turbine 23. In one particularly illustrative embodiment, the superheat in the working fluid at 6 would be as close as possible to zero although this embodiment of the present invention describes a system that allows large amount of superheat at 5 and at 6 and still remains efficient by recovering lost heat in the economizer heat exchanger 21.

In another illustrative embodiment where the working fluid is bromine, the temperature of the working fluid at point 2 may be between approximately 50-250° F. at approximately 1540 psia at the discharge of the pump 19. The working fluid at point 13 may be at a pressure of approximately 11 psia at the discharge of the condenser 26 for a system pressure ratio of approximately one hundred and forty to one (140:1). The temperature of the bromine working fluid 5 at the exit of the heat exchanger 22 may be approximately 800-1200° F. The temperature of the bromine working fluid 6 at the exit of the turbine 23 may be approximately 130-180° F. at a pressure of approximately 13 psia.

In another illustrative embodiment where the working fluid is carbon tetrachloride, the temperature of the working fluid at point 2 may be between approximately 50-250° F. at approximately 690 psia at the discharge of the pump 19. The working fluid at point 6 may be at a pressure of approximately 6 psia at the discharge of the condenser 26 for a system pressure ratio of approximately one hundred thirty to one (130:1). The temperature of the carbon tetrachloride working fluid 5 at the exit of the heat exchanger 22 may be approximately 580-900° F. The temperature of the carbon tetrachloride working fluid 6 at the exit of the turbine 23 may be approximately 225-525° F. at a pressure of approximately 10 psia.

In another illustrative embodiment where the working fluid is ethyl alcohol or ethanol, the temperature of the working fluid at point 2 may be between approximately 50-250° F. at approximately 1000 psia at the discharge of the pump 19. The working fluid at point 13 may be at a pressure of approximately 4 psia at the discharge of the condenser 26 for a system pressure ratio of approximately two hundred and fifty to one (250:1). The temperature of the ethyl alcohol or ethanol working fluid 5 at the exit of the heat exchanger 22 may be approximately 600-1000° F. The temperature of the ethyl alcohol or ethanol working fluid 6 at the exit of the turbine 23 may be approximately 210-615° F. at a pressure of approximately 8 psia.

In another illustrative embodiment where the working fluid is R-150A, the temperature of the working fluid at point 2 may be between approximately 50-250° F. at approximately 770 psia at the discharge of the pump 19. The working fluid may be at a pressure of approximately 11 psia at the discharge of the condenser 26 for a system pressure ratio of approximately seventy to one (70:1). The temperature of the R-150A working fluid 5 at the exit of the heat exchanger 22 may be approximately 500-900° F. The temperature of the R-150A working fluid 6 at the exit of the turbine 23 may be approximately 165-595° F. at a pressure of approximately 15 psia.

In another illustrative embodiment where the working fluid is thiophene, the temperature of the working fluid at point 2 may be between approximately 50-250° F. at approximately 900 psia at the discharge of the pump 19. The working fluid at point 13 may be at a pressure of approximately 4.5 psia at the discharge of the condenser 26 for a system pressure ratio of approximately two hundred to one (200:1). The temperature of the thiophene working fluid 5 at the exit of the heat exchanger 22 may be approximately 600-800° F. The temperature of the thiophene working fluid 6 at the exit of the turbine 23 may be approximately 210-480° F. at a pressure of approximately 8.5 psia.

In another illustrative embodiment where the working fluid is a mixture of hydrocarbon compounds, the temperature of the working fluid at point 2 may be between approximately 50-250° F. at approximately 576 psia at the discharge of the pump 19. The working fluid at point 13 may be at a pressure of approximately 36 psia at the discharge of the condenser 26 for a system pressure ratio of approximately sixteen to one (16:1). The temperature of the mixture of hydrocarbon compounds working fluid 5 at the exit of the heat exchanger 22 may be approximately 520-660° F. The temperature of the mixture of hydrocarbon compounds working fluid 6 at the exit of the turbine 23 may be approximately 375-800° F. at a pressure of approximately 40 psia. For this illustrative example, the mixture of hydrocarbons on a molar basis may be approximately 10% propane, 10% isobutane, 10% isopentane, 20% hexane, 20% heptane, 10% octane, 10% nonane, and 10% decane. This mixture is one of an infinite number of possible mixture that might be selected to suit specific needs of a particular embodiment and is no way representative of the only or best solution.

Figure 4:
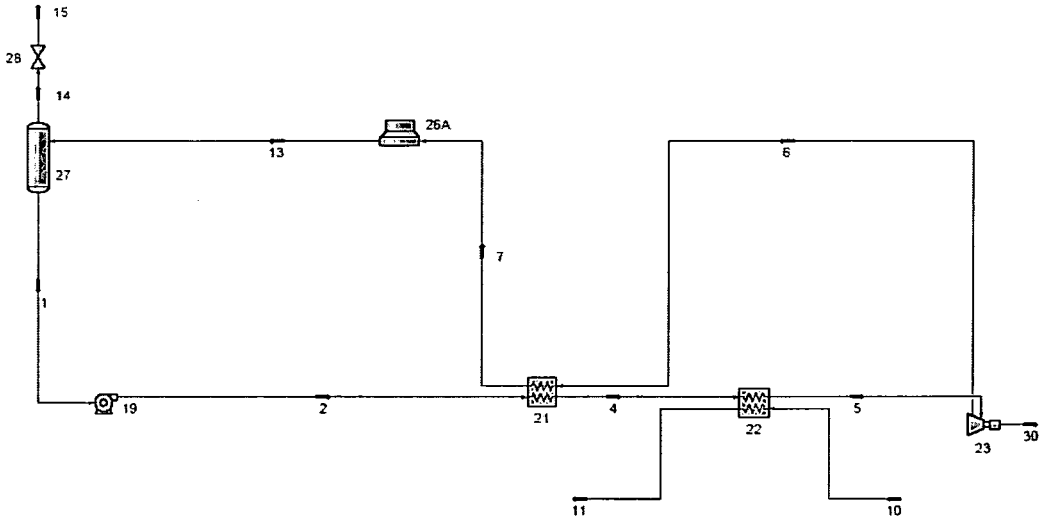
FIG. 4 is a schematic diagram of one illustrative embodiment of the present invention employing a working fluid circulating pump, an economizer heat exchanger, a heat recovery heat exchanger, a turbine or expander, a gas or air cooled condenser heat exchanger, and an accumulator.

In another illustrative embodiment of the present invention a system substantially similar to FIG. 3 will now be described with reference to FIG. 4. The low pressure, high temperature discharge 6 from the turbine 23 is routed to a condenser heat exchanger 26A after passing through the economizer heat exchanger 21. The condenser 26A condenses the slightly superheated, low pressure gas 7 to the liquid state using air or other gas most preferably with a fan used to draw or force the gas over a heat exchanger for the purpose of enhancing heat transfer. The condenser 26A may be utilized to condense the hot working fluid from a vapor to a liquid at a temperature ranging from approximately 0-250° F. The most notable difference between the embodiment of FIG. 3 and the embodiment of FIG. 4 is that the condenser heat exchanger 26A is gas cooled for the later and liquid cooled for the former (see FIG. 3, item 26).

Figure 5:
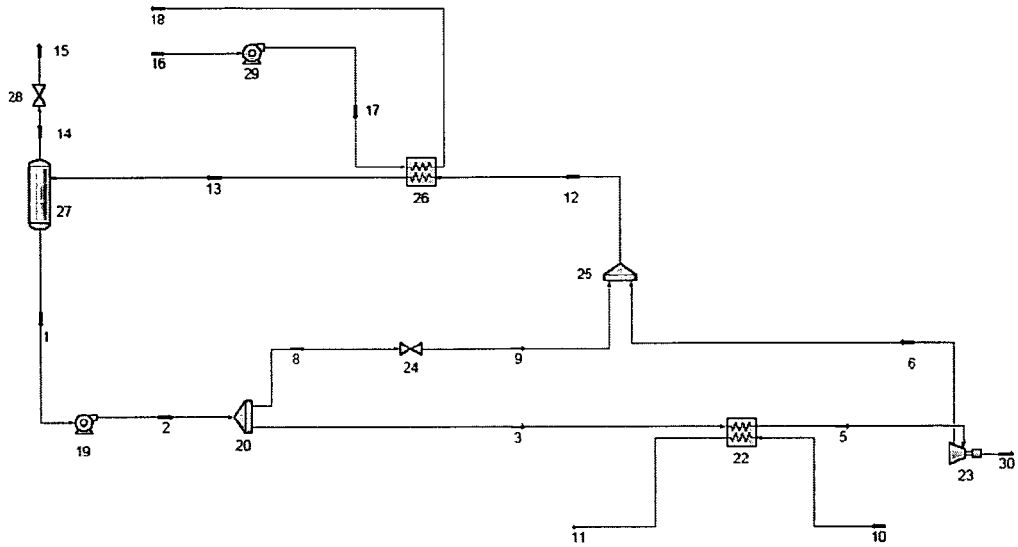
FIG. 5 is a schematic diagram of one illustrative embodiment of the present invention employing a working fluid circulating pump, a desuperheater heat exchanger, a heat recovery heat exchanger, a turbine or expander, a liquid cooled condenser heat exchanger, a cooling liquid circulating pump, and an accumulator.

In another illustrative embodiment of the present invention, as shown in FIG. 5, a system similar to FIG. 1 is utilized with the addition of a desuperheater heat exchanger 25 and a flow control valve 24 to reduce the cost of the system by reducing the temperature of the exhaust vapor 6 exiting the turbine 23 by mixing the exhaust vapor 6 with a portion 9 of the cold, high pressure liquid 2 after dividing the flow in a flow divider 20. The portion of cool, high pressure liquid from flow divider 20 is passed through flow control valve 24 and discharged to stream 9. The flow control valve 24 insures that the proper amount of liquid is supplied to streams 3 and 8/9 by varying the position of the valve 24 and thereby changing the flow quantities in streams 3, 8, and 9. After the cool, low pressure liquid is discharged from the control valve 24 via stream 9 it is introduced into the direct contact desuperheater 25 wherein it is mixed with the hot, low pressure vapor 6 exiting the turbine 23. The discharge from the desuperheater 25 is then routed via line 12 to the condenser heat exchanger 26. The desuperheater heat exchanger 25 has the benefit of reducing the size and cost of the condenser heat exchanger 26.

As shown in FIG. 5, a high pressure liquid 3 enters a heat recovery heat exchanger 22 and exits as a vapor 5 due to heat transfer with a hot fluid, either a gas, a liquid, or a two-phase mixture of gas and liquid entering at 10 and exiting at 11. The vapor 5 may be a subcritical or supercritical vapor. The heat recovery heat exchanger 22 may be any type of heat exchanger capable of transferring heat from one fluid stream to another fluid stream. The source of the hot fluid 10 for the heat exchanger 22 may either be a waste heat source (from any of a variety of sources) or heat may intentionally be supplied to the system, or the like. In one illustrative embodiment, the source of the hot fluid 10 for the heat exchanger 22 is a waste heat source such as the exhaust from an internal combustion engine, a combustion gas turbine, a compressor, or an industrial or manufacturing process.

In one embodiment, the vapor 5 then enters the turbine (expander) 23 and the vapor 5 is expanded in the turbine 23. The design of the turbine 23 converts kinetic and potential energy of the dry vapor 5 into mechanical energy in the form of torque on an output shaft 30. Any type of commercially available turbine suited for use in the systems described herein may be employed, e.g. an expander, a turbo-expander, a power turbine, etc. The shaft horsepower available on the shaft 30 of the turbine 23 can be used to produce power by driving one or more generators, compressors, pumps, or other mechanical devices, either directly or indirectly. Additionally, as will be recognized by those skilled in the art after a complete reading of the present application, a plurality of turbines 23 or heat recovery heat exchangers 22 may be employed with the system depicted in FIG. 5.

The low pressure, high temperature discharge 6 from the turbine 23 is routed to the desuperheater heat exchanger 25. The desuperheater heat exchanger 25 cools, via direct contact heat transfer with the cool liquid 9, the superheated, low pressure gas 6. The desuperheater heat exchanger 25 normally is designed to cool the hot vapor 6 from the turbine 23 to within 50° F. of its dew point. In one particularly illustrative embodiment, the cooled vapor 12 leaving the desuperheater 25 is at its dew point.

The slightly superheated, low pressure, low temperature discharge 12 from the desuperheater heat exchanger 25 is routed to a condenser heat exchanger 26. The condenser 26 condenses the slightly superheated, low pressure gas 12 to the liquid state using water, seawater, or other liquid or boiling fluid 17 which might be circulated by a low pressure liquid circulating pump 29 which provides the necessary motive force to circulate the cooling fluid from point 16 to point 18. The vapor leaving the desuperheater may be, at times, slightly wet, i.e. at or below its dew point temperature, with a mixture of both liquid and vapor present without adversely affecting the performance of the condenser 26. The condenser 26 may be utilized to condense the hot working fluid from a vapor to a liquid at a temperature ranging from approximately 50-250° F.

The condensed liquid 13 is introduced into an accumulator drum 27. As described previously, the drum 27 may serve several purposes, such as, for example: (a) the design of the drum 27 ensures that the pump 19 has sufficient head to avoid cavitation; (b) the design of the drum 27 ensures that the supply of liquid 1 to the pump 19 is steady; (c) the design of the drum 27 ensures that the pump 19 will not be run dry; (d) the design of the drum 27 provides an opportunity to evacuate any non-condensable vapors from the system through a vent valve 28 via lines 14, 15; (e) the design of the drum 27 allows for the introduction of process liquid into the system; and (f) the design of the drum 27 allows for the introduction of makeup quantities of the process liquid in the event that a small amount of operating fluid is lost. The high pressure discharge 2 of the pump 19 is fed to the flow divider 20. The pump 19 may be any type of commercially available pump sufficient to meet the pumping requirements of the systems disclosed herein. In various embodiments, the pump 19 may be sized such that the discharge pressure of the working fluid ranges from approximately 300 psia to 1500 psia. In the most preferred embodiment, the selection of the discharge pressure of the pump 19 is dependent on the critical pressure of the working fluid 2 and should be approximately 5 psia to 500 psia greater than the critical pressure of the working fluid 2 although pressures lower than the critical pressure may be utilized with a reduction in the efficiency of the system.

As shown in FIG. 5, a high pressure liquid 2 enters a flow divider 20 which may be as simple as a piping tee and exits as two portions (3, 8), each a high pressure liquid, the first portion is routed to a heat recovery heat exchanger 22 via line 3 and the second portion is routed to the desuperheater heat exchanger 25 via line 8, a flow control valve 24, and line 9. The flow fraction in line 8 is approximately five to thirty percent (5 to 30%) of the total flow of working fluid in line 2. Likewise, the flow fraction in line 3 is approximately seventy to ninety five percent (70 to 95%) of the total flow of working fluid in line 2. In one embodiment, the amount of cool, liquid working fluid 2 utilized in the desuperheater heat exchanger 25 is selected such that the discharge vapor 12 from the desuperheater 25 is near its dew point. Excess flow in lines 8 and 9 reduces the efficiency of the system; but, such a condition has no other significant adverse impact provided the discharge temperature of the vapor 5 from the heat recovery heat exchanger 33 is within acceptable limits. For periods of reduced heat input of the hot fluid 10 into the heat recovery heat exchanger 22 it may be desirable to utilize the flow control valve 24 as a temperature control valve to regulate the conditions of the hot vapor 5 exiting the heat recovery heat exchanger 22 by increasing or decreasing the flow in line 8 thereby decreasing or increasing the flow in line 3 and increasing or decreasing the temperature of the hot vapor 5 exiting the heat recovery heat exchanger 22.

Figure 6:
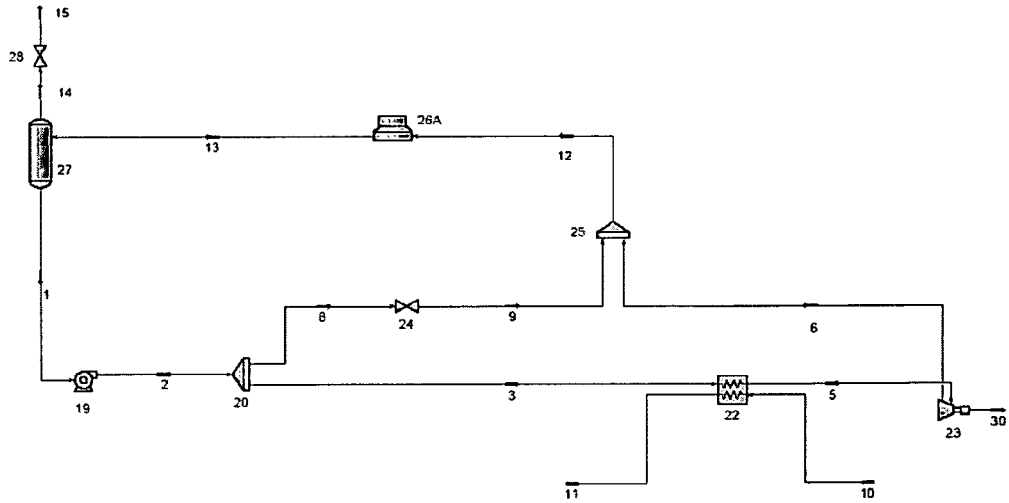
FIG. 6 is a schematic diagram of one illustrative embodiment of the present invention employing a working fluid circulating pump, a desuperheater heat exchanger, a heat recovery heat exchanger, a turbine or expander, a gas or air cooled condenser heat exchanger, and an accumulator.

In another illustrative embodiment of the present invention a system substantially similar to FIG. 5 will now be described with reference to FIG. 6. The low pressure, high temperature discharge 6 from the turbine 23 is routed to a condenser heat exchanger 26A after passing through the desuperheater heat exchanger 25. The condenser 26A condenses the slightly superheated, low pressure gas 12 to the liquid state using air or other gas most preferably with a fan used to draw or force the gas over a heat exchanger for the purpose of enhancing heat transfer. The condenser 26A may be utilized to condense the hot working fluid from a vapor to a liquid at a temperature ranging from approximately 0-250° F. The most notable difference between the embodiment of FIG. 5 and the embodiment of FIG. 6 is that the condenser heat exchanger 26A is gas cooled for the later and liquid cooled for the former (see FIG. 5, item 26).

Figure 7:
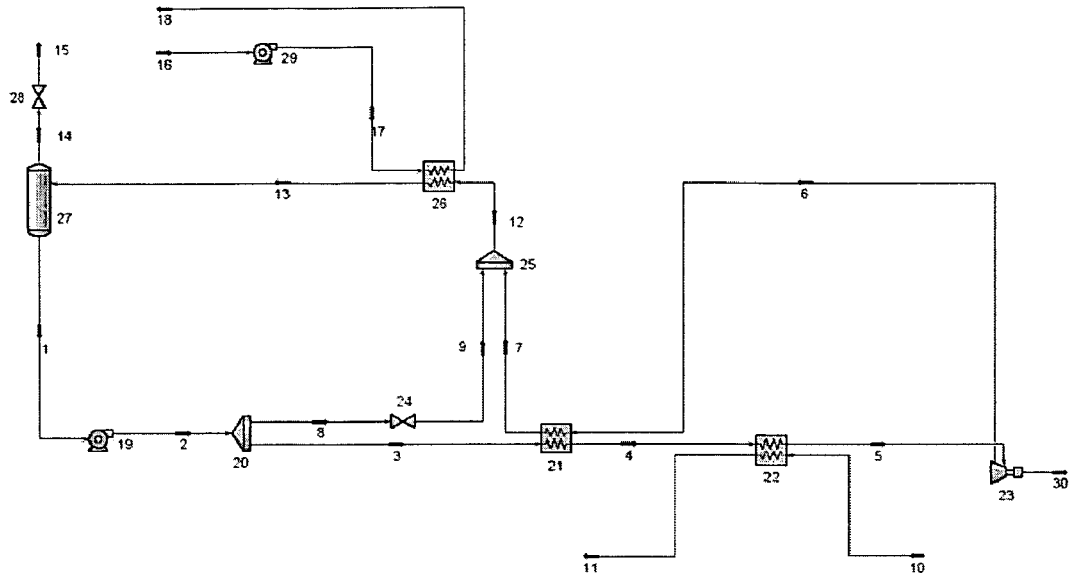
FIG. 7 is a schematic diagram of one illustrative embodiment of the present invention employing a working fluid circulating pump, an economizer heat exchanger, a desuperheater heat exchanger, a heat recovery heat exchanger, a turbine or expander, a liquid cooled condenser heat exchanger, a cooling liquid circulating pump, and an accumulator.

In another illustrative embodiment of the present invention, as shown in FIG. 7, a system similar to FIG. 1 and combining the benefits of FIGS. 3 and 5 therein is utilized with the addition of an economizer heat exchanger 21, a desuperheater heat exchanger 25, and a flow control valve 24 to both reduce the cost of the system by reducing the temperature of the exhaust vapor 6 after exiting the turbine 23 and after flowing through economizer 21 by mixing with a portion the cold, high pressure liquid 2 after dividing the flow in the flow divider 20. The portion of cool, high pressure liquid from flow divider 20 is passed through flow control valve 24 and discharged to stream 9. The flow control valve 24 insures that the proper amount of liquid is supplied to streams 3 and 8/9 by varying the position of the valve 24 and thereby changing the flows in lines 3, 8, and 9. After the cool, low pressure liquid is discharged from the control valve 24 via stream 9 it is introduced into the direct contact desuperheater 25 wherein it is mixed with the cooled, low pressure vapor 7 exiting the turbine 23 after passing through an economizer 21. The discharge from the desuperheater 25 is then routed via line 12 to the condenser heat exchanger 26. The desuperheater heat exchanger 25 has the benefit of reducing the size and cost of the condenser heat exchanger 26.

As shown in FIG. 7, a second portion of the cool, high pressure liquid 2 is supplied from the flow divider 20 via line 3 to an economizer 21 that cools the hot, low pressure vapor 6 from turbine 23 by heat transfer with the working fluid in line 3 thereby preheating said working fluid before introduction into the heat recovery heat exchanger 22. The preheated, high pressure liquid 4 enters a heat recovery heat exchanger 22 and exits as a vapor 5 due to heat transfer with a hot fluid, either a gas, a liquid, or a two-phase mixture of gas and liquid entering at 10 and exiting at 11. The vapor 5 may be a subcritical or supercritical vapor. The heat recovery heat exchanger 22 may be any type of heat exchanger capable of transferring heat from one fluid stream to another fluid stream. The source of the hot fluid 10 for the heat exchanger 22 may either be a waste heat source (from any of a variety of sources) or heat may intentionally be supplied to the system, or the like. In one illustrative embodiment, the source of the hot fluid 10 for the heat exchanger 22 is a waste heat source such as the exhaust from an internal combustion engine, a combustion gas turbine, a compressor, or an industrial or manufacturing process.

In one embodiment, the vapor 5 then enters the turbine (expander) 23 and the vapor 5 is expanded in the turbine 23. The design of the turbine 23 converts kinetic and potential energy of the dry vapor 5 into mechanical energy in the form of torque on an output shaft 30. Any type of commercially available turbine suited for use in the systems described herein may be employed, e.g. an expander, a turbo-expander, a power turbine, etc. The shaft horsepower available on the shaft 30 of the turbine 23 can be used to produce power by driving one or more generators, compressors, pumps, or other mechanical devices, either directly or indirectly. Additionally, as will be recognized by those skilled in the art after a complete reading of the present application, a plurality of turbines 23 or heat recovery heat exchangers 22 may be employed with the system depicted in FIG. 7.

The low pressure, high temperature discharge 6 from the turbine 23 is routed to a desuperheater heat exchanger 25 after flowing through an economizer heat exchanger 21. The desuperheater heat exchanger 25 cools, via direct contact heat transfer with the cool liquid 9, the superheated, low pressure gas 7 after said gas exits an economizer heat exchanger 21. The desuperheater heat exchanger 25 normally is designed to cool the hot vapor 6 from the turbine 23 to within 50° F. of its dew point. In one particularly illustrative embodiment, the cooled vapor 12 leaving the desuperheater 25 is at its dew point.

The low pressure, low temperature discharge 12 from the desuperheater heat exchanger 25 is routed to the condenser heat exchanger 26. The condenser 26 condenses the slightly superheated, low pressure gas 12 to the liquid state using water, seawater, or other liquid or boiling fluids 17 which might be circulated by a low pressure liquid circulating pump 29 which provides the necessary motive force to circulate the cooling fluid from point 16 to point 18. The vapor leaving the desuperheater may be, at times, slightly wet, i.e. at or below its dew point temperature, with a mixture of both liquid and vapor present without adversely affecting the performance of the condenser 26. The condenser 26 may be utilized to condense the hot working fluid from a vapor to a liquid at a temperature ranging from approximately 50-250° F.

The condensed liquid 13 is introduced into an accumulator drum 27. As described previously, the drum 27 may serve several purposes, such as, for example: (a) the design of the drum 27 ensures that the pump 19 has sufficient head to avoid cavitation; (b) the design of the drum 27 ensures that the supply of liquid 1 to the pump 19 is steady; (c) the design of the drum 27 ensures that the pump 19 will not be run dry; (d) the design of the drum 27 provides an opportunity to evacuate any non-condensable vapors from the system through a vent valve 28 via lines 14, 15; (e) the design of the drum 27 allows for the introduction of process liquid into the system; and (f) the design of the drum 27 allows for the introduction of makeup quantities of process liquid in the event that a small amount of operating fluid is lost. The high pressure discharge 2 of the pump 19 is fed to the flow divider 20. The pump 19 may be any type of commercially available pump sufficient to meet the pumping requirements of the systems disclosed herein. In various embodiments, the pump 19 may be sized such that the discharge pressure of the working fluid ranges from approximately 300 psia to 1500 psia. In one particularly illustrative embodiment, the selection of the discharge pressure of the pump 19 is dependent on the critical pressure of the working fluid 2 and should be approximately 5 psia to 500 psia greater than the critical pressure of the working fluid 2 although pressures lower than the critical pressure may be utilized with a reduction in the efficiency of the system.

As shown in FIG. 7, a high pressure liquid 2 enters a flow divider 20 which may be as simple as a piping tee and exits as two portions (3, 8), each a high pressure liquid, the first portion is routed to a heat recovery heat exchanger 22 after passing through an economizer heat exchanger 21 via lines 3 and 4 and the second portion is routed to the desuperheater heat exchanger 25 via line 8, a flow control valve 24, and line 9. The flow fraction in line 8 is approximately five to thirty percent (5 to 30%) of the total flow of working fluid in line 2. Likewise the flow fraction in line 3 is approximately seventy to ninety five percent (70 to 95%) of the total flow of working fluid in line 2. In one embodiment, the amount of cool, liquid working fluid 2 utilized in the desuperheater heat exchanger 25 is selected such that the discharge vapor 12 from the desuperheater 25 is near its dew point. Excess flow in lines 8 and 9 reduces the efficiency of the system; but, such a condition has no other significant adverse impact provided the discharge temperature of the vapor 5 from the heat recovery heat exchanger 22 is within acceptable limits. For periods of reduced heat input of the hot fluid 10 into the heat recovery heat exchanger 22 it may be desirable to utilize the flow control valve 24 as a temperature control valve to regulate the conditions of the hot vapor 5 exiting the heat recovery heat exchanger 22 by increasing or decreasing the flow in line 8 thereby decreasing or increasing the flow in line 3 and increasing or decreasing the temperature of the hot vapor 5 exiting the heat recovery heat exchanger 22.

Figure 8:
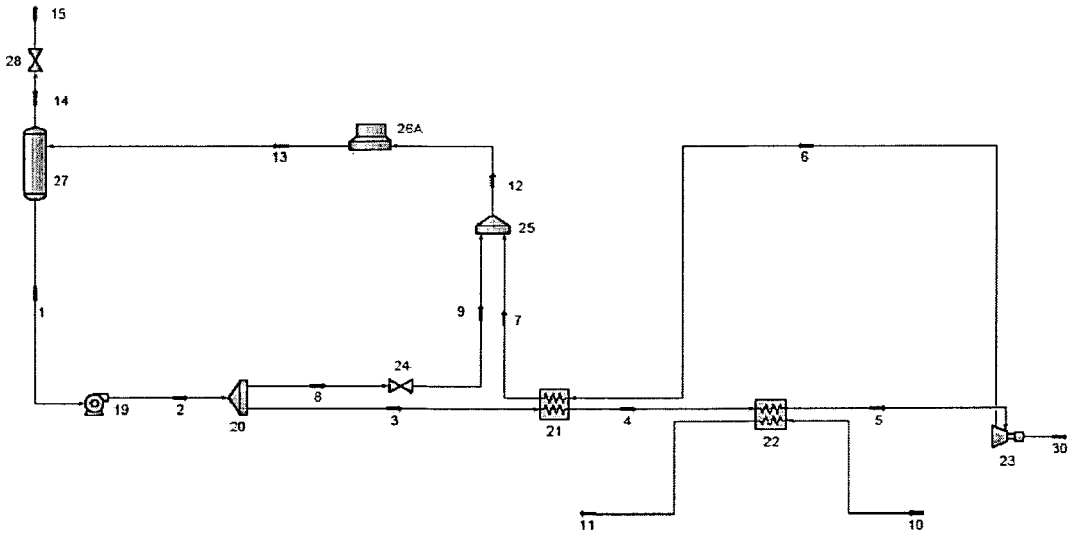
FIG. 8 is a schematic diagram of one illustrative embodiment of the present invention employing a working fluid circulating pump, an economizer heat exchanger, a desuperheater heat exchanger, a heat recovery heat exchanger, a turbine or expander, a gas or air cooled condenser heat exchanger, and an accumulator.

In another illustrative embodiment of the present invention a system substantially similar to FIG. 7 will now be described with reference to FIG. 8. The low pressure, high temperature discharge 6 from the turbine 23 is routed to a condenser heat exchanger 26A after passing through an economizer heat exchanger 21, and a desuperheater heat exchanger 25. The condenser 26A condenses the slightly superheated, low pressure gas 12 to the liquid state using air or other gas most preferably with a fan used to draw or force the gas over a heat exchanger for the purpose of enhancing heat transfer. The condenser 26A may be utilized to condense the hot working fluid from a vapor to a liquid at a temperature ranging from approximately 0-250° F. The most notable difference between the embodiment of FIG. 7 and the embodiment of FIG. 8 is that the condenser heat exchanger 26A is gas cooled for the later and liquid cooled for the former (see FIG. 7, item 26).

Figure 9A:
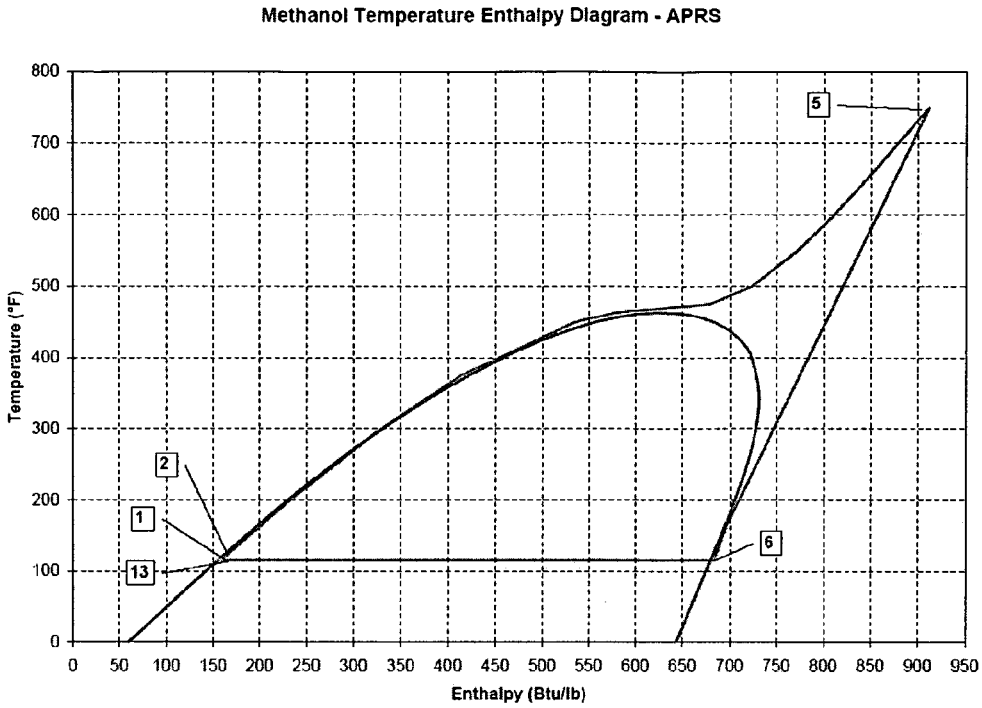
FIGS. 9A through 9F are illustrative thermodynamic plots of a working fluid, methanol, employed in various systems of the present invention.

FIG. 9A is an illustrative temperature versus enthalpy diagram that illustrates the thermodynamic relationship of the present invention as compared to the physical arrangement of the system of FIG. 1 using, as an example, methanol as the working fluid. The physical conditions of the working fluid at points 1, 2, 5, 6, and 13 of FIG. 1 correspond directly to the thermodynamic states shown by the same labels on FIG. 9A.

Figure 9B:
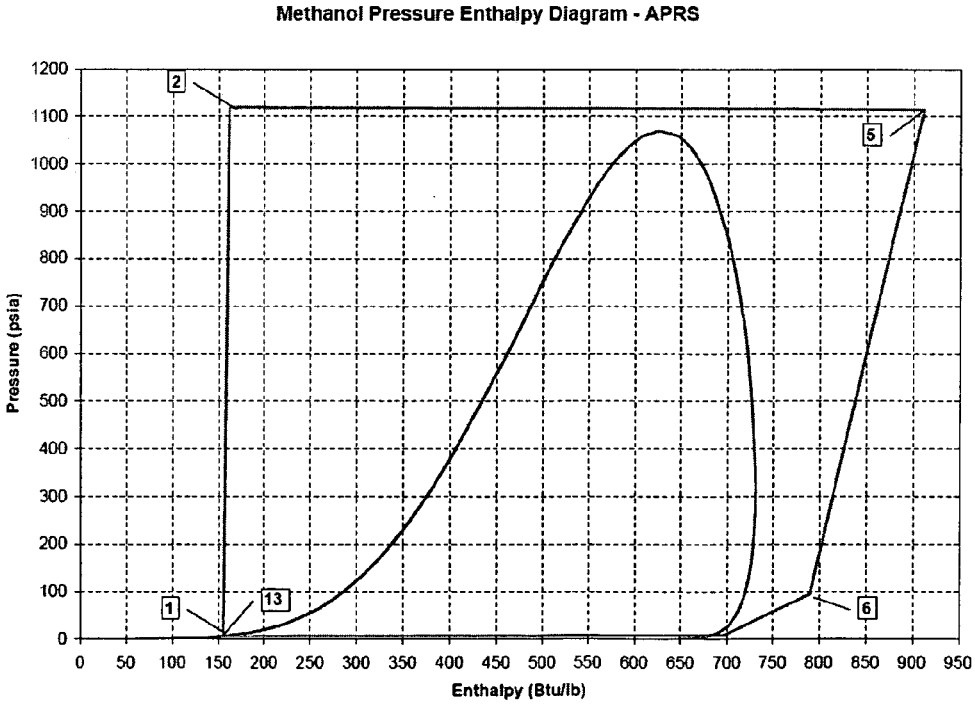

FIG. 9B is an illustrative pressure versus enthalpy diagram that illustrates the thermodynamic relationship of the present invention as compared to the physical arrangement of the system of FIG. 1 using, as an example, methanol as the working fluid. The physical conditions of the working fluid at points 1, 2, 5, 6, and 13 of FIG. 1 correspond directly to the thermodynamic states shown by the same labels on FIG. 9B.

Figure 9C:
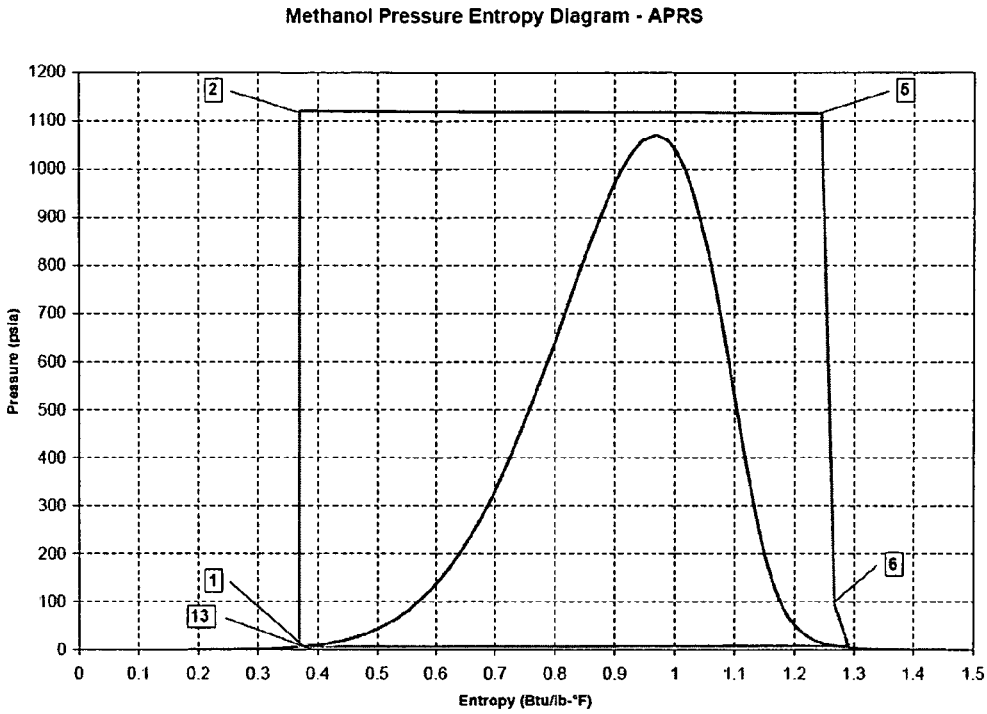

FIG. 9C is an illustrative pressure versus enthalpy diagram that illustrates the thermodynamic relationship of the present invention as compared to the physical arrangement of the system of FIG. 1 using, as an example, methanol as the working fluid. The physical conditions of the working fluid at points 1, 2, 5, 6, and 13 of FIG. 1 correspond directly to the thermodynamic states shown by the same labels on FIG. 9C.

Figure 9D:
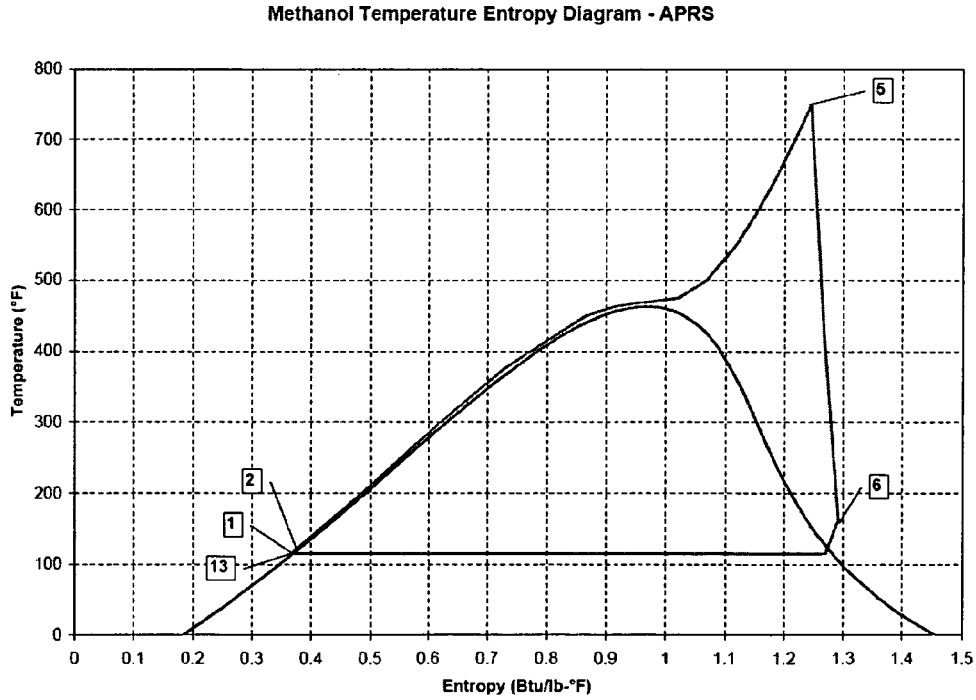

FIG. 9D is an illustrative temperature versus enthalpy diagram that illustrates the thermodynamic relationship of the present invention as compared to the physical arrangement of the system of FIG. 1 using, as an example, methanol as the working fluid. The physical conditions of the working fluid at points 1, 2, 5, 6, and 13 of FIG. 1 correspond directly to the thermodynamic states shown by the same labels on FIG. 9D.

After reading the present application, those skilled in the art will understand that similar illustrative examples are possible and of similar construction for FIGS. 3, 4, 5, 6, 7, and 8. The thermodynamic states for FIG. 2 are identical to the states of FIG. 1.

Figure 9E:
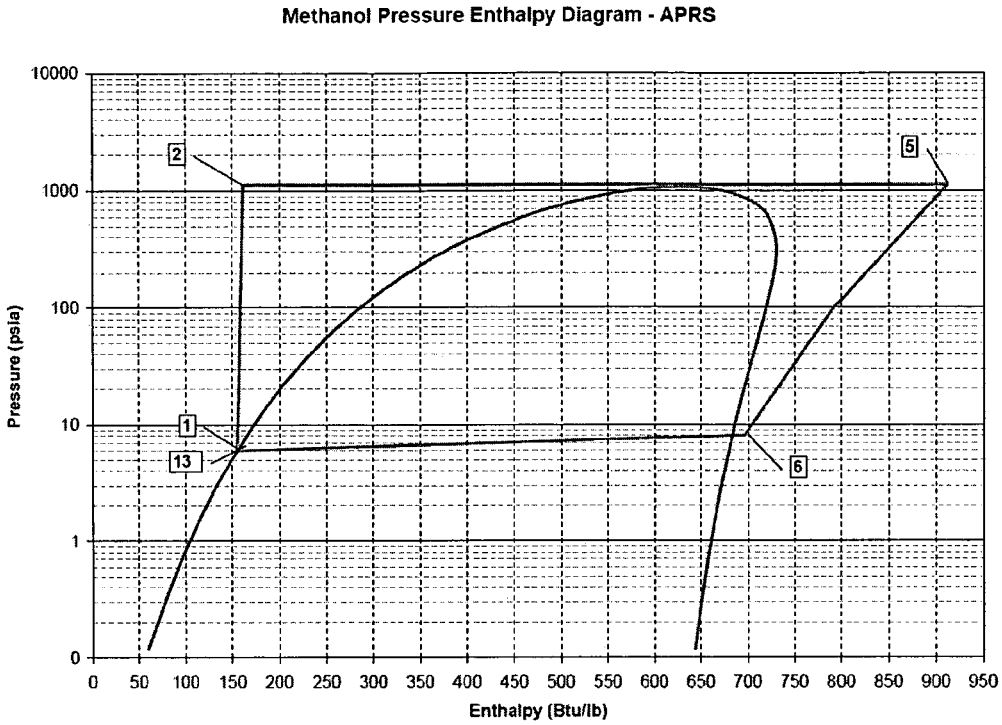

In yet another illustrative example the system of FIG. 9B is described with reference to FIG. 9E. FIG. 9E is identical to FIG. 9B expect that the vertical axis indicating the values of pressure is plotted on a logarithmic scale versus the linear scale of FIG. 9B.

Figure 9F:
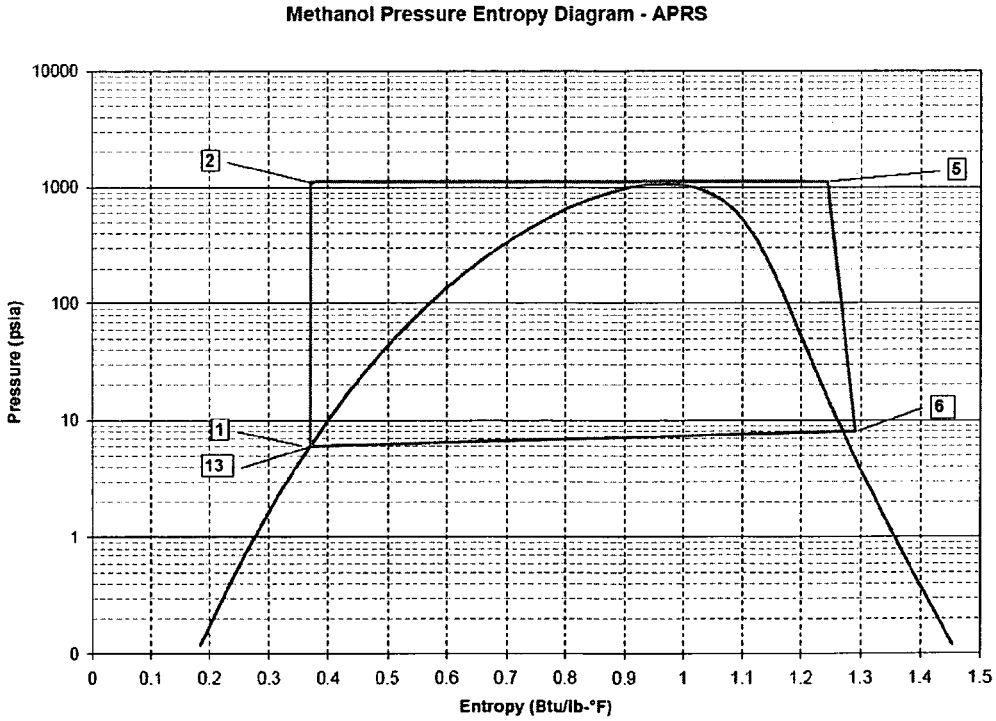

In yet another illustrative example the system of FIG. 9D is described with reference to FIG. 9F. FIG. 9F is identical to FIG. 9D expect that the vertical axis indicating the values of pressure is plotted on a logarithmic scale versus the linear scale of FIG. 9D.

Figure 10:
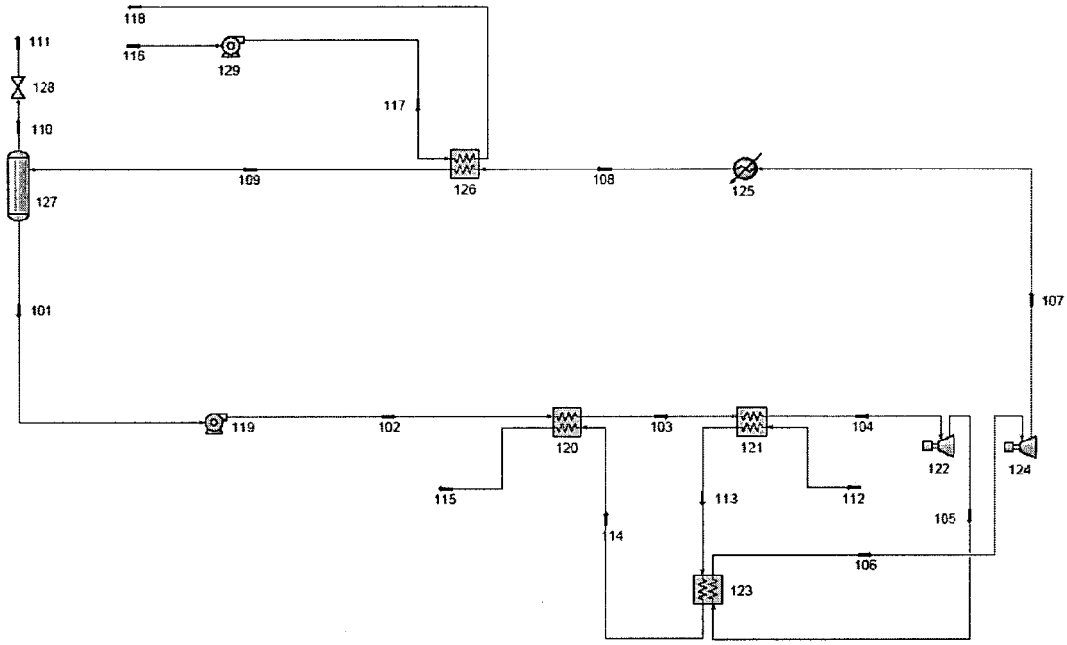
Figure 10 (Prior Art)
FIG. 10 is a schematic diagram of one illustrative embodiment of the prior art employed as an Organic Rankine Cycle with two turbines or expanders and one reheat.

As set forth in the Background section of the application, the system depicted in FIG. 10 is an example of the prior art system for heat recovery. The system of FIG. 10 describes a state of the prior art example embodying two heat recovery heat exchangers 120 and 121, two turbines (expanders) 122 and 124, and a reheater heat exchanger 123. The prior art system may or may not have a separate gas cooler 125 and condenser 126. It is most notable that the gas cooler 125 of the prior art system differs significantly from the desuperheater 25 of the present invention in that the prior art gas cooler 125 utilizes a separate cooling fluid such as air or water indirectly as the cooling medium whereas the present invention utilizes the working fluid by direct contact as the cooling medium. To those skilled in the art, these are two, distinct, and separate devices.

Moreover, although the system of FIG. 10, and Organic Rankine Cycle (ORC) with one reheat, is more efficient than either a simple, one turbine ORC or a two turbine, no reheat ORC, the system is significantly less efficient than the present invention. In some applications, the present invention can often produce fifty to one hundred percent (50-100%) more power than the prior art system depicted in FIG. 10.

The present invention reduces or overcomes all four of the limitations of the prior art system depicted in FIG. 10. More specifically, the present invention a) recovers all or nearly all of the internal and external heat before condensing the working fluid, b) utilizes a typically supercritical working fluid thereby increasing the efficiency of heat recovery and the power output capacity of the system, c) generates less entropy and thereby loses less heat to chaos, and d) is far less complicated having, typically, one turbine and one heat recovery heat exchanger. Even for the more complicated embodiments of the present invention, the complexity and cost of the present invention are more favorable since the turbine(s) and the heat recovery heat exchanger(s) are usually the largest costs in a system of this type.

FIGS. 11A-11F are similar to FIGS. 9A-9F and show the advantages. similarities, and differences between the current invention and the prior art system depicted in FIG. 10. For purposes of this example, both systems are operated with methyl alcohol as the working fluid. The states of FIG. 11 refer to the conditions of the working fluid in the system shown in FIGS. 1 and 10. Points 1, 2, 5, 6, and 13 correspond to FIG. 1 and points 101, 102, 103, 104, 105, 106, 107, and 108 correspond to FIG. 10.

Figure 11A:
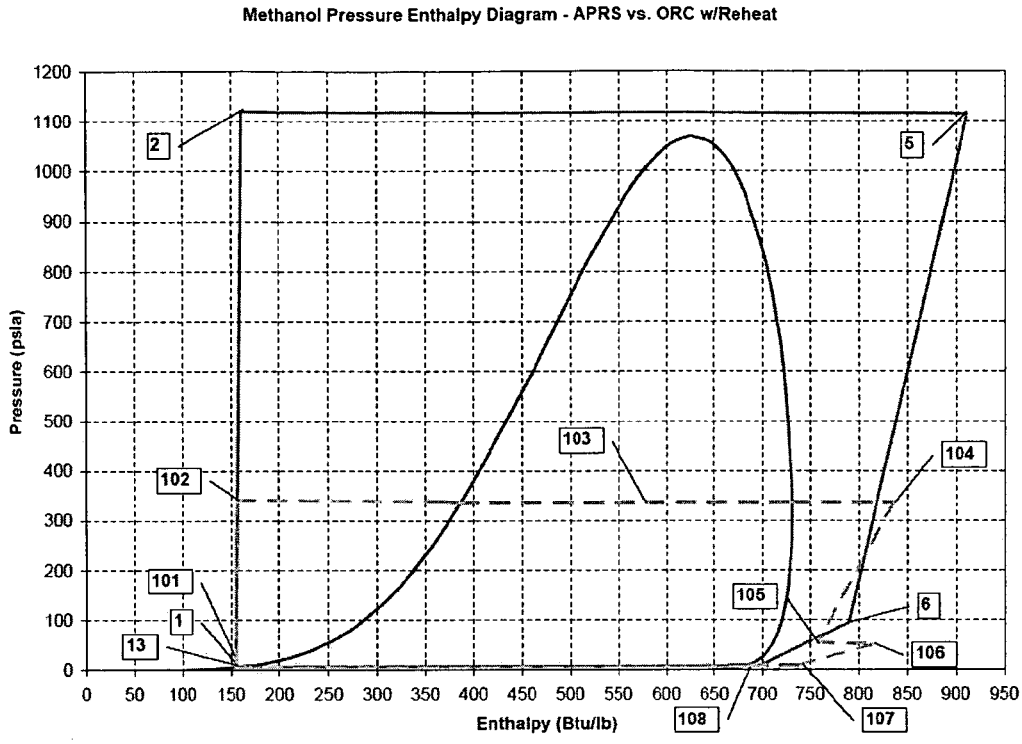
FIGS. 11A through 11F are illustrative thermodynamic plots of a working fluid, methanol, employed in various systems of the present invention and a comparison to a traditional Organic Rankine Cycle with one reheat.

As with FIG. 9, FIG. 11 show various thermodynamic cycles with FIG. 11A depicting a pressure-enthalpy diagram comparing the current invention (APRS) with the prior art (ORC). FIG. 11B displays a temperature-enthalpy diagram. FIG. 11C displays a pressure-entropy diagram. FIG. 11D displays a temperature-entropy diagram. FIG. 11E is the same as FIG. 11B except the pressure values are on a logarithmic scale. Likewise, FIG. 11F is the same as FIG. 11D except the pressure values are on a logarithmic scale.

FIG. 11A most clearly depicts a difference in operating pressure between the prior art system depicted in FIG. 10 and the present invention. As the total heat recovered and the total power output of the system are related to the area encompassed by the thermodynamic cycle, it is clear that the area enclosed with 1-2-5-6-13 is significantly greater than the area enclosed within 101-102-103-104-105-106-107-108.

Figure 11B:
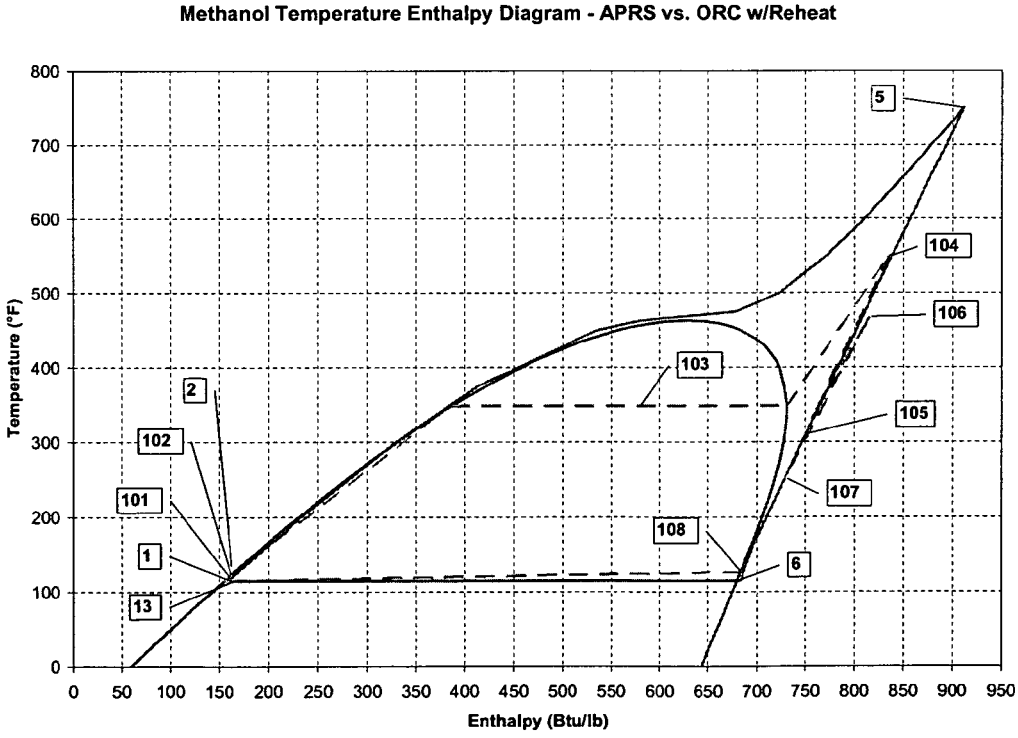

FIG. 11B also clearly depicts another significant difference in operating conditions for the working fluid between the prior art system shown in FIG. 10 and the present invention. In the present invention, the liquid working fluid travels from state 1 to state 2 to state 5 without ever entering the thermodynamic dome, i.e. never boiling. In stark contrast, the working fluid of the prior art system shown in FIG. 10 goes from point 101 to point 102 and is heated to the bubble point of the working fluid at the high pressure state and boils in the first heat recovery heat exchanger 120 passing through point 103 between the first and second heat recovery heat exchangers 120 and 121 as a wet vapor 103. Such vapor 103 is further boiled and superheated in the second heat recovery heat exchanger 121 before introduction into the first turbine 122 at state 104. Notice the substantial increase in temperature and pressure for the present invention at state 5 versus the corresponding state for the prior art system 104.

Figure 11C:
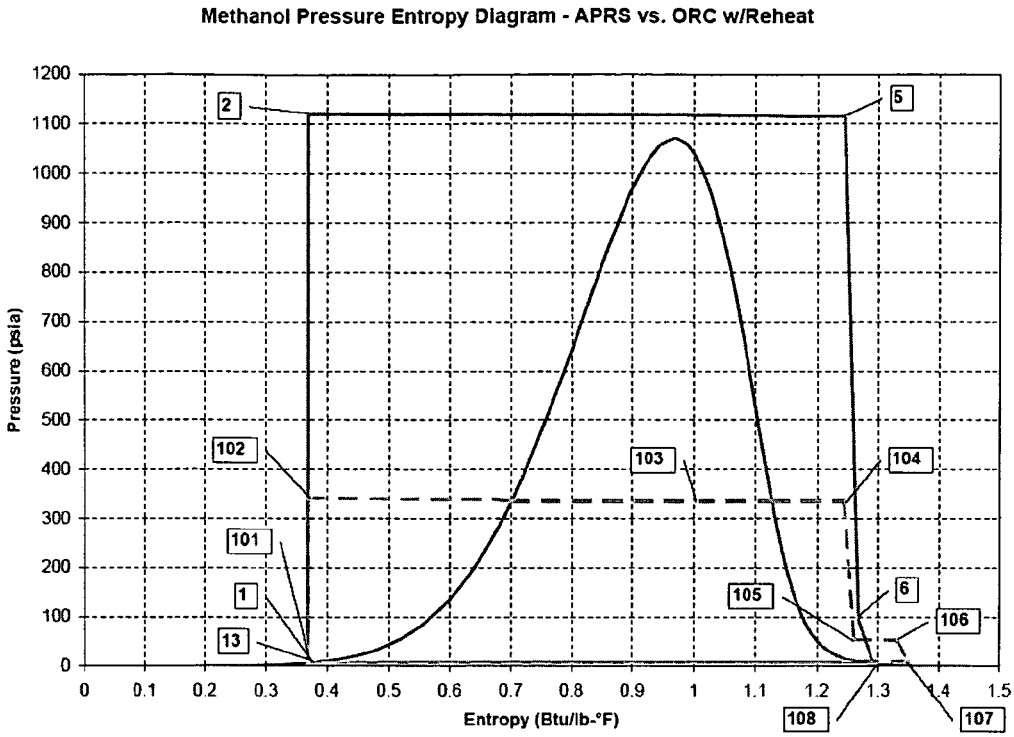
Figure 11D:
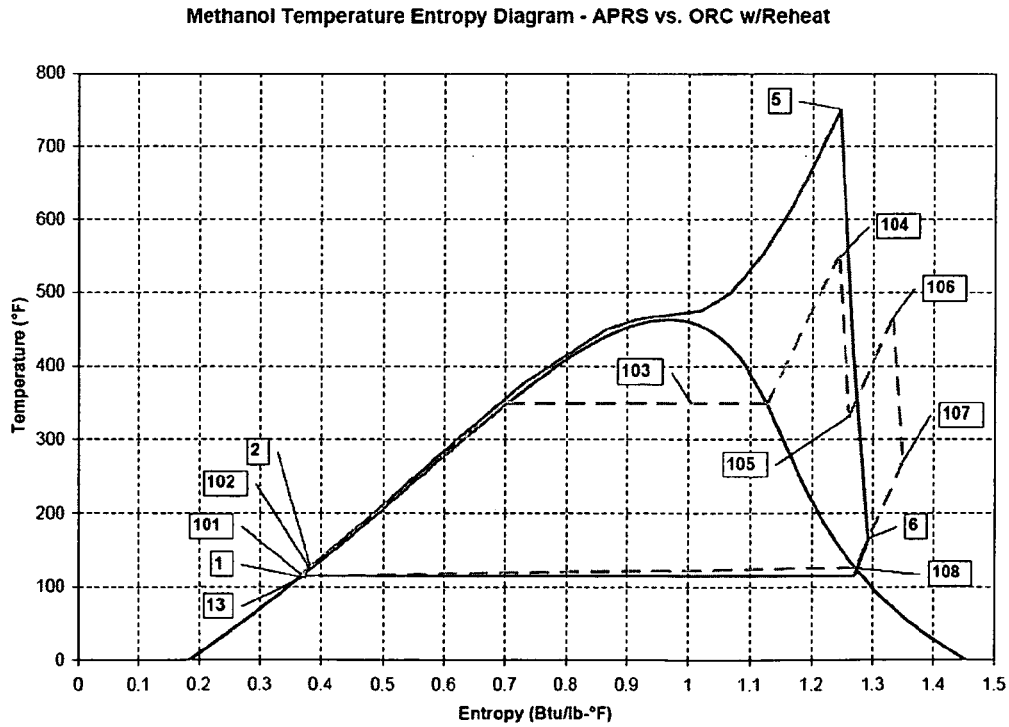
Figure 11E:
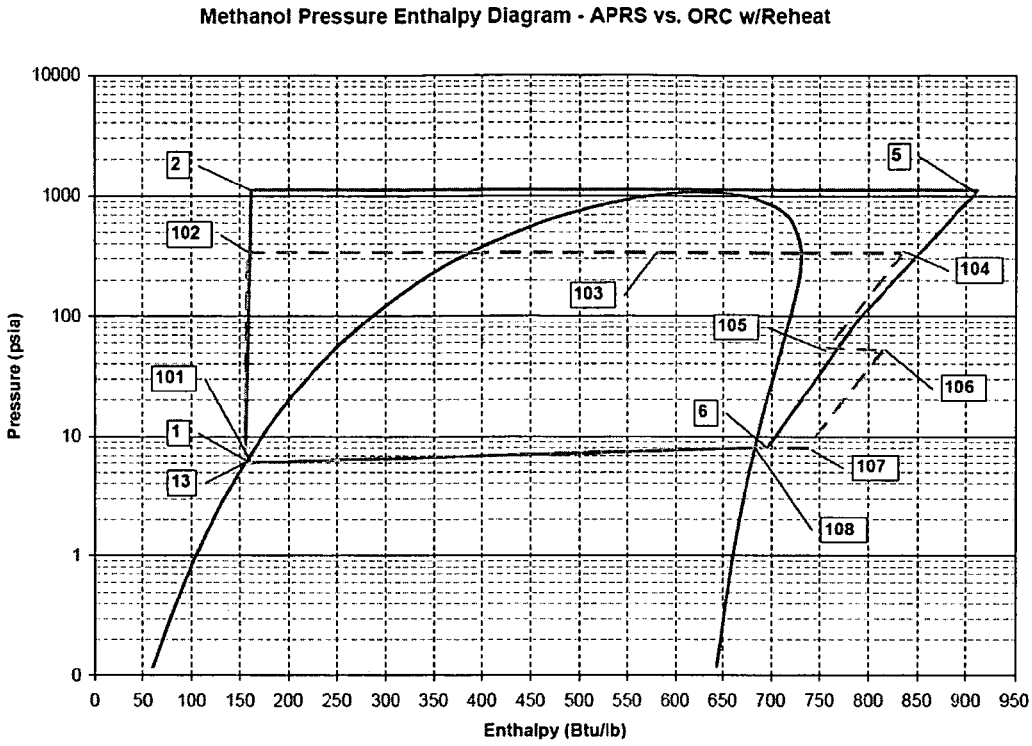
Figure 11F:
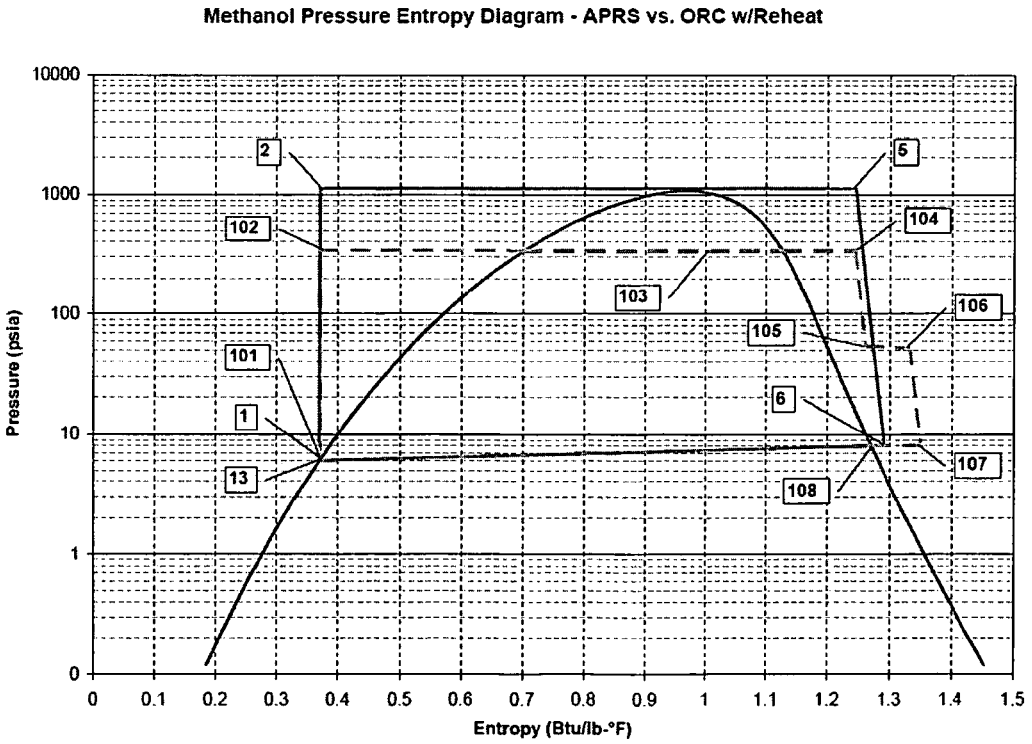

FIG. 11C also depicts yet another significant difference in operating conditions for the working fluid between the prior art system shown in FIG. 10 and the present invention and more clearly displays the flow path of the liquid streams. In the present invention, the liquid working fluid travels from state 1 to state 2 to state 5 without ever entering the thermodynamic dome, i.e. never boiling. In stark contrast, the working fluid of the prior art system shown in FIG. 10 goes from point 101 to point 102 and is heated to the bubble point of the working fluid at the high pressure state and boils in the first heat recovery heat exchanger 120 passing through point 103 between the first and second heat recovery heat exchangers 120 and 121 as a wet vapor 103. Such vapor 103 is further boiled and superheated in the second heat recovery heat exchanger 121 before introduction into the first turbine 122 at state 104. Notice the substantial increase in pressure for the present invention at state 5 versus the corresponding state for the prior art system 104. Further note the lower entropy at the turbine discharge state 6 for the present invention versus the corresponding point 107 for the prior art FIG. 11D also shows a further significant difference in operating conditions for the working fluid between the prior art system depicted in FIG. 10 and the present invention. Notice the substantial increase in temperature for the present invention at state 5 versus the corresponding state for the prior art system 104. Further note the lower entropy and much lower temperature at the turbine discharge state 6 for the present invention versus the corresponding point 107 for the prior art.

In one specific embodiment of the present invention, the mechanical power available at the output shaft 30 of the turbine 23 may be utilized directly or through a gearbox to provide mechanical work to drive an electrical power generator to produce electrical power either as a constant voltage and constant frequency AC source or as a DC source which might be rectified to produce AC power at a constant voltage and constant frequency.

In another specific embodiment, the mechanical power available at the output shaft 30 of the turbine 23 may be utilized directly or through a gearbox to provide mechanical work to drive any combination of mechanical devices such as a compressor, a pump, a wheel, a propeller, a conveyer, a fan, a gear, or any other mechanical device(s) requiring or accepting mechanical power input. Moreover, the present invention is not restricted to stationary devices, as it may be utilized in or on an automobile, a ship, an aircraft, a spacecraft, a train, or other non-stationary vessel.

A specific byproduct of the method of the present invention is an effective and dramatic reduction in the emissions of both pollutants and greenhouse gases. This method may not require any fuel nor does it generate any pollutants or greenhouse gases or any other gases as byproducts. Any process to which this method may be applied, such as a gas turbine or a diesel engine, will generate significantly more power with no increase in fuel consumption or pollution. The effect of this method is a net reduction in the specific pollution generation rate on a mass per power produced basis.

The present invention is generally directed to various systems and methods for producing mechanical power from a heat source. In various illustrative examples, the devices employed in practicing the present invention may include a heat recovery heat exchanger, a turbine, an economizer heat exchanger, a desuperheater heat exchanger, a condenser heat exchanger, an accumulator, and a liquid circulating pump, etc. In one illustrative embodiment, the system comprises a first heat exchanger adapted to receive a fluid from a heat source and a working fluid, wherein, when the working fluid is passed through the first heat exchanger, the working fluid is converted to a vapor via heat transfer from the heat contained in the fluid from the heat source, at least one turbine adapted to receive the vapor, and an optional economizer heat exchanger adapted to receive exhaust vapor from the turbine and the working fluid, wherein a temperature of the working fluid is adapted to be increased via heat transfer with the exhaust vapor from the turbine prior to the introduction of the working fluid into the first heat exchanger. The system further comprises a condenser heat exchanger that is adapted to receive the exhaust vapor from the turbine after the exhaust vapor has passed through the optional economizer heat exchanger and a cooling fluid, wherein a temperature of the exhaust vapor is reduced via heat transfer with the cooling fluid, and a pump that is adapted to circulate the working fluid to the optional economizer heat exchanger.

In another illustrative embodiment, the system comprises a first heat exchanger adapted to receive a fluid from a heat source and a working fluid, wherein, when the working fluid is passed through the first heat exchanger, the working fluid is converted to a vapor via heat transfer from the heat contained in the fluid from the heat source, and at least one turbine adapted to receive the vapor. The system further comprises a desuperheater heat exchanger adapted to receive exhaust vapor from the turbine and a portion of the working fluid extracted upstream of the first heat exchanger, wherein the temperature of the exhaust vapor from the turbine is adapted to be reduced via heat transfer with the working fluid in the desuperheater heat exchanger, a condenser heat exchanger that is adapted to receive working fluid exiting the desuperheater heat exchanger and a cooling fluid, wherein a temperature of the working fluid is adapted to be reduced via heat transfer with the cooling fluid in the condenser heat exchanger, and a pump adapted to circulate the working fluid to the first heat exchanger.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system, comprising:

a first heat exchanger adapted to receive a heating stream from a heat source and a first portion of the working fluid other than water, wherein, when the first portion of the working fluid is passed through the first heat exchanger, and converted to a vapor via heat transfer from the heat contained in said heating stream from said heat source;

at least one turbine adapted to receive said vapor and produce rotational, mechanical power to a shaft that is adapted to transmit said power to at least one device adapted to receive said power;

a direct contact desuperheater heat exchanger adapted to receive said exhaust vapor from said at least one turbine and a second portion of said working fluid, wherein the temperature of the second portion of said working fluid is adapted to be increased via heat transfer with said exhaust vapor from said at least one turbine while the temperature of said exhaust vapor from said at least one turbine is reduced in said direct contact desuperheater heat exchanger;

a condenser heat exchanger that is adapted to receive said exhaust vapor from said direct contact desuperheater heat exchanger and a cooling fluid, wherein a temperature of said exhaust vapor from said direct contact desuperheater heat exchanger is reduced via heat transfer with said cooling fluid;

a liquid accumulator that is adapted to receive said cooled working fluid, provide storage for said cooled working fluid, and provide a surge volume for said system;

at least one pump that is adapted to circulate said working fluid to said first heat exchanger;

a flow splitter that is adapted to divide the working fluid from said at least one pump into at least said first and second portions, wherein said first portion is supplied to said first heat exchanger and said second portion is supplied to said desuperheater heat exchanger; and, a flow regulating valve adapted to receive said second portion of said working fluid and regulate the flow of and reduce the pressure of said second portion of said working fluid before supplying said second portion of said working fluid to said desuperheater heat exchanger.

2. The system of claim 1, wherein said working fluid enters said first heat exchanger as a supercritical liquid and via heat transfer with the heating stream from said heat source changes state from a supercritical liquid to a supercritical vapor.

3. The system of claim 1, wherein said cooling fluid for said condenser heat exchanger comprises at least one of a liquid and a gas.

4. The system of claim 1, wherein said cooling fluid for said condenser heat exchanger is a partially or fully vaporized liquid in passing through said condenser heat exchanger.

5. The system of claim 1, wherein said condenser heat exchanger is adapted to condense the exhaust vapor from said at least one turbine to a liquid at a temperature between approximately 50-250° F.

6. The system of claim 1, wherein said working fluid is methyl alcohol (methanol) or one of its derivatives and said fluid from said heat source has a temperature of between approximately 500-2500° F., the maximum temperature of the working fluid is between approximately 463-963° F., and wherein said pump is adapted to operate at a discharge pressure greater than approximately 1070 psia.

7. The system of claim 1, wherein said working fluid is bromine and said fluid from said heat source has a temperature of between approximately 500-2500° F., the maximum temperature of the working fluid is between approximately 592-1092° F., and wherein said pump is adapted to operate at a discharge pressure greater than approximately 1500 psia.

8. The system of claim 1, wherein said working fluid is carbon tetrachloride and said fluid from said heat source has a temperature of between approximately 600-2500° F., the maximum temperature of the working fluid is between approximately 542-1042° F., and wherein said pump is adapted to operate at a discharge pressure greater than approximately 1000 psia.

9. The system of claim 1, wherein said working fluid is ethyl alcohol or one of its derivatives and said fluid from said heat source has a temperature of between approximately 500-2500° F., the maximum temperature of the working fluid is between approximately 470-970° F., and wherein said pump is adapted to operate at a discharge pressure greater than approximately 920 psia.

10. The system of claim 1, wherein said working fluid is R-150A and said fluid from said heat source has a temperature of between approximately 500-2500° F., the maximum temperature of the working fluid is between approximately 482-982° F., and wherein said pump is adapted to operate at a discharge pressure greater than approximately 730 psia.

11. The system of claim 1, wherein said working fluid is thiophene and said fluid from said heat source has a temperature of between approximately 600-2500° F., the maximum temperature of the working fluid is between approximately 583-1083° F., and wherein said pump is adapted to operate at a discharge pressure greater than approximately 730 psia.

12. The system of claim 1, wherein said working fluid is a mixture of hydrocarbons containing ten or fewer carbon atoms per molecule and said fluid from said heat source has a temperature of between approximately 400-2500° F., the maximum temperature of the working fluid is between approximately 400-1000° F., and wherein said pump is adapted to operate at a discharge pressure greater than approximately 300 psia.

13. The system of claim 1, wherein said at least one turbine drives at least one electrical generator to produce electrical power.

14. The system of claim 1, wherein said at least one turbine drives at least one compressor.

15. The system of claim 1, wherein said at least one turbine drives said at least one pump.

16. The system of claim 1, wherein said at least one turbine drives at least one electrical generator to produce electrical power and said at least one pump.

17. A system, comprising:

a first heat exchanger adapted to receive a heating stream from a heat source and a first portion of the working fluid other than water, wherein, when the first portion of the working fluid is passed through the first heat exchanger, and converted to a vapor via heat transfer from the heat contained in said heating stream from said heat source;

at least one turbine adapted to receive said vapor and produce rotational, mechanical power to a shaft that is adapted to transmit said power to at least one device adapted to receive said power;

an economizer heat exchanger adapted to receive exhaust vapor from said at least one turbine and said first portion of the working fluid, wherein the temperature of the first portion of the working fluid is adapted to be increased via heat transfer with said exhaust vapor from said at least one turbine prior to the introduction of said first portion of the working fluid into said first heat exchanger;

a direct contact desuperheater heat exchanger adapted to receive said exhaust vapor from said at least one turbine after it passes through said economizer heat exchanger and a second portion of said working fluid, wherein the temperature of the second portion of said working fluid is adapted to be increased via heat transfer with said exhaust vapor from said at least one turbine while the temperature of said exhaust vapor is reduced by heat transfer in said economizer heat exchanger;

a condenser heat exchanger that is adapted to receive said exhaust vapor from said economizer heat exchanger and a cooling fluid, wherein a temperature of said exhaust vapor from said economizer heat exchanger is reduced via heat transfer with said cooling fluid;

a liquid accumulator that is adapted to receive said cooled working fluid, provide storage for said cooled working fluid, and provide a surge volume for said system;

at least one pump that is adapted to circulate said working fluid to said first heat exchanger;

a flow splitter that is adapted to divide the working fluid from said at least one pump into at least said first and second portions, wherein said first portion is supplied to said economizer heat exchanger and said second portion is supplied to said desuperheater heat exchanger; and, a flow regulating valve adapted to receive said second portion of said working fluid and regulate the flow of and reduce the pressure of said second portion of said working fluid before supplying said second portion of said working fluid to said desuperheater heat exchanger.

18. The system of claim 17, wherein said working fluid enters said first heat exchanger as a supercritical liquid and via heat transfer with the heating stream from said heat source changes state from a supercritical liquid to a supercritical vapor.

19. The system of claim 17, wherein said cooling fluid for said condenser heat exchanger comprises at least one of a liquid and a gas.

20. The system of claim 17, wherein said cooling fluid for said condenser heat exchanger is a partially or fully vaporized liquid in passing through said condenser heat exchanger.

21. The system of claim 17, wherein said condenser heat exchanger is adapted to condense the exhaust vapor from said at least one turbine to a liquid at a temperature between approximately 50-250° F.

22. The system of claim 17, wherein said working fluid is methyl alcohol (methanol) or one of its derivatives and said fluid from said heat source has a temperature of between approximately 500-2500° F., the maximum temperature of the working fluid is between approximately 463-963° F., and wherein said pump is adapted to operate at a discharge pressure greater than approximately 1070 psia.

23. The system of claim 17, wherein said working fluid is bromine and said fluid from said heat source has a temperature of between approximately 500-2500° F., the maximum temperature of the working fluid is between approximately 592-1092° F., and wherein said pump is adapted to operate at a discharge pressure greater than approximately 1500 psia.

24. The system of claim 17, wherein said working fluid is carbon tetrachloride and said fluid from said heat source has a temperature of between approximately 600-2500° F., the maximum temperature of the working fluid is between approximately 542-1042° F., and wherein said pump is adapted to operate at a discharge pressure greater than approximately 1000 psia.

25. The system of claim 17, wherein said working fluid is ethyl alcohol or one of its derivatives and said fluid from said heat source has a temperature of between approximately 500-2500° F., the maximum temperature of the working fluid is between approximately 470-970° F., and wherein said pump is adapted to operate at a discharge pressure greater than approximately 920 psia.

26. The system of claim 17, wherein said working fluid is R-150A and said fluid from said heat source has a temperature of between approximately 500-2500° F., the maximum temperature of the working fluid is between approximately 482-982° F., and wherein said pump is adapted to operate at a discharge pressure greater than approximately 730 psia.

27. The system of claim 17, wherein said working fluid is thiophene and said fluid from said heat source has a temperature of between approximately 600-2500° F., the maximum temperature of the working fluid is between approximately 583-1083° F., and wherein said pump is adapted to operate at a discharge pressure greater than approximately 730 psia.

28. The system of claim 17, wherein said working fluid is a mixture of hydrocarbons containing ten or fewer carbon atoms per molecule and said fluid from said heat source has a temperature of between approximately 400-2500° F., the maximum temperature of the working fluid is between approximately 400-1000° F., and wherein said pump is adapted to operate at a discharge pressure greater than approximately 300 psia.

29. The system of claim 17, wherein said at least one turbine drives at least one electrical generator to produce electrical power.

30. The system of claim 17, wherein said at least one turbine drives at least one compressor.

31. The system of claim 17, wherein said at least one turbine drives said at least one pump.

32. The system of claim 17, wherein said at least one turbine drives at least one electrical generator to produce electrical power and said at least one pump.

* * * * *